US011011097B2

(12) United States Patent
Han et al.

(10) Patent No.: US 11,011,097 B2
(45) Date of Patent: May 18, 2021

(54) METHOD FOR DRIVING DISPLAY PANEL AND COMPUTER READABLE STORAGE MEDIUM

(71) Applicants: Beijing BOE Optoelectronics Technology Co., Ltd., Beijing (CN); BOE Technology Group Co., Ltd., Beijing (CN)

(72) Inventors: Wenchao Han, Beijing (CN); Yifan Song, Beijing (CN); Wei Sun, Beijing (CN); Jigang Sun, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/395,652

(22) Filed: Apr. 26, 2019

(65) Prior Publication Data

US 2020/0105178 A1 Apr. 2, 2020

(30) Foreign Application Priority Data

Sep. 28, 2018 (CN) ..... 201811142691.3

(51) Int. Cl.
*G09G 3/20* (2006.01)

(52) U.S. Cl.
CPC ... *G09G 3/2003* (2013.01); *G09G 2310/0235* (2013.01); *G09G 2310/0297* (2013.01); *G09G 2320/0233* (2013.01)

(58) Field of Classification Search
CPC combination set(s) only.
See application file for complete search history.

(56) References Cited

U.S. PATENT DOCUMENTS 9,870,749 B2 1/2018 Yoo et al.
10,049,638 B2 8/2018 Lin
(Continued)

FOREIGN PATENT DOCUMENTS

CN 101292277 A 10/2008
CN 105427781 A 3/2016
(Continued)

OTHER PUBLICATIONS

First Office Action, including Search Report, for Chinese Patent Application No. 201811142691.3, dated Jan. 19, 2021, 22 pages.

*Primary Examiner* — Van N Chow
(74) *Attorney, Agent, or Firm* — Westman, Champlin & Koehler, P.A.

(57) ABSTRACT

A method for driving a display panel is disclosed. The display panel includes a plurality of sub-pixels arranged in an array, a plurality of data input ports, a plurality of groups of data lines, and a plurality of groups of selection switches, wherein each group of data lines includes a plurality of data lines coupled to the same data input port through a plurality of selection switches in a corresponding group of selection switches. The method includes: sequentially turning on a plurality of selection switches according to a first sequence when an $M^{th}$ row of sub-pixels of the display panel is scanned; and sequentially turning on the plurality of selection switches according to a second sequence when an $(M+1)^{th}$ row of sub-pixels of the display panel is scanned, wherein M is a positive integer greater than or equal to 1, and the first sequence is different from the second sequence.

14 Claims, 12 Drawing Sheets

(56) References Cited

U.S. PATENT DOCUMENTS

| | | | | |
|---|---|---|---|---|
| 10,403,223 | B2 | 9/2019 | Wen et al. | |
| 10,699,627 | B2 | 6/2020 | Um et al. | |
| 2009/0002355 | A1 | 1/2009 | Iwatsu | |
| 2010/0110045 | A1* | 5/2010 | Fu | G09G 3/3611 345/204 |
| 2014/0240300 | A1* | 8/2014 | Katsuta | G09G 3/3614 345/204 |
| 2016/0078826 | A1 | 3/2016 | Yoo et al. | |
| 2016/0104407 | A1* | 4/2016 | Hong | G09G 3/3648 345/55 |
| 2017/0352320 | A1* | 12/2017 | Lin | G09G 3/3677 |
| 2018/0047353 | A1 | 2/2018 | Lin | |
| 2019/0012978 | A1 | 1/2019 | Wen et al. | |
| 2019/0347976 | A1 | 11/2019 | Um et al. | |

FOREIGN PATENT DOCUMENTS

| | | | |
|---|---|---|---|
| CN | 105469765 | A | 4/2016 |
| CN | 106842657 | A | 6/2017 |
| CN | 107331362 | A | 11/2017 |
| CN | 108335663 | A | 7/2018 |
| JP | 2008224809 | A | 9/2008 |

* cited by examiner

METHOD FOR DRIVING DISPLAY PANEL AND COMPUTER READABLE STORAGE MEDIUM

CROSS-REFERENCE TO RELATED APPLICATION(S)

This application claims priority to the Chinese Patent Application No. CN201811142691.3, filed on Sep. 28, 2018, which is incorporated herein by reference in its entirety.

TECHNICAL FIELD

The present disclosure relates to, but is not limited to, the field of display technologies, and more particularly, to a method for driving a display panel and a computer readable storage medium.

BACKGROUND

Display panels in which White (W for short) sub-pixels are added to conventional Red, Green and Blue (RBG for short) sub-pixels to form Red, Green Blue and White sub-pixels (i.e., RGBW sub-pixels) have been widely applied in various display devices since the display panels designed with RGBW sub-pixels have better light transmittance, higher brightness, and lower power consumption.

In an existing display panel having RGBW sub-pixels, selection switches for controlling turn-on and turn-off of rows of sub-pixels, for example, data multiplexers ("muxes" for short), are usually designed as a 1:3mux arrangement. In the design of the arrangement, sub-pixels in adjacent rows of light-emitting pixels are arranged in different orders. A conventional mixed color picture is a reloaded image, and a plurality of sub-pixels with the same color in the same row of sub-pixels are turned on by the respective different muxes to be charged, which may result in differences in the charging of the plurality of sub-pixels with the same color in a case of a specific display image, and thus cause differences in brightness of the sub-pixels with same color. The reloaded image described above means that an output waveform at a source of a Thin Film Transistor (TFT for short) is variable. In addition, in an existing design of a turn-on timing of muxes, the muxes are turned on in the same manner between respective different frames. Thereby, respective frames and respective rows of sub-pixels have the same coupling state therebetween. If there are differences in brightness of sub-pixels due to coupling of the sub-pixels when each row of muxes is turned on, it may result in a display effect of horizontal stripes and vertical stripes on the display panel, which greatly affects the display effect of the display panel.

SUMMARY

According to the embodiments of the present disclosure, there is provided a method for driving a display panel, the display panel comprising a plurality of sub-pixels arranged in an array, a plurality of data input ports, a plurality of groups of data lines, and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels, the method comprising:

sequentially turning on a plurality of selection switches according to a first sequence when an $M^{th}$ row of sub-pixels of the display panel is scanned; and sequentially turning on the plurality of selection switches according to a second sequence when an $(M+1)^{th}$ row of sub-pixels of the display panel is scanned, wherein M is a positive integer greater than or equal to 1, and the first sequence is different from the second sequence.

In an embodiment, the plurality of selection switches comprise a first selection switch, a second selection switch, and a third selection switch.

In an embodiment, the first sequence is (the first selection switch, the second selection switch, the third selection switch), and the second sequence is (the third selection switch, the second selection switch, the first selection switch), or the first sequence is (the first selection switch, the third selection switch, the second selection switch), and the second sequence is (the second selection switch, the third selection switch, the first selection switch).

In an embodiment, the first sequence is (the second selection switch, the third selection switch, the first selection switch), and the second sequence is (the first selection switch, the third selection switch, the second selection switch), or the first sequence is (the second selection switch, the first selection switch, the third selection switch), and the second sequence is (the third selection switch, the first selection switch, the second selection switch).

In an embodiment, the first sequence is (the third selection switch, the second selection switch, the first selection switch), and the second sequence is (the first selection switch, the second selection switch, the third selection switch), or the first sequence is (the third selection switch, the first selection switch, the second selection switch), and the second sequence is (the second selection switch, the first selection switch, the third selection switch).

In an embodiment, scanning an $M^{th}$ row of sub-pixels of the display panel comprises:

sequentially turning on the plurality of selection switches according to a third sequence when the $M^{th}$ row of sub-pixels of the display panel is scanned in an $N^{th}$ frame; and sequentially turning on the plurality of selection switches according to a fourth sequence when the $M^{th}$ row of sub-pixels of the display panel is scanned in an $(N+1)^{th}$ frame, wherein N is a positive integer greater than or equal to 1, and the third sequence is different from the fourth sequence.

In an embodiment, the plurality of selection switches comprise a first selection switch, a second selection switch, and a third selection switch.

In an embodiment, the third sequence is (the first selection switch, the second selection switch, the third selection switch), and the fourth sequence is (the third selection switch, the second selection switch, the first selection switch).

In an embodiment, the third sequence is (the first selection switch, the third selection switch, the second selection switch), and the fourth sequence is (the second selection switch, the third selection switch, the first selection switch).

In an embodiment, the third sequence is (the second selection switch, the third selection switch, the first selection switch), and the fourth sequence is (the first selection switch, the third selection switch, the second selection switch).

In an embodiment, the third sequence is (the second selection switch, the first selection switch, the third selection switch), and the fourth sequence is (the third selection switch, the first selection switch, the second selection switch).

In an embodiment, the third sequence is (the third selection switch, the second selection switch, the first selection switch), and the fourth sequence is (the first selection switch, the second selection switch, the third selection switch).

In an embodiment, the third sequence is (the third selection switch, the first selection switch, the second selection switch), and the fourth sequence is (the second selection switch, the first selection switch, the third selection switch).

In an embodiment, the sub-pixels comprise red, green, blue, and white sub-pixels, and adjacent rows of sub-pixels have sub-pixels with different colors in the same column.

In an embodiment, the plurality of data input ports comprise a plurality of groups of data input ports, each group of data input ports among the plurality of groups of data input ports has a first data input port and a second data port, the first data input port is coupled to a group of data lines through one group of selection switches among two groups of selection switches, and the second data input port is coupled to another group of data lines through the other group of selection switches among the two groups of selection switches, wherein the first data input port is configured to input a first data voltage, and the second data input port is configured to input a second data voltage having a polarity opposite to that of the first data voltage.

According to the embodiments of the present disclosure, there is provided a method for driving a display panel, the display panel comprising a plurality of sub-pixels arranged in an array, a plurality of data input ports, a plurality of groups of data lines and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels, the method comprising:

sequentially turning on the plurality of selection switches according to a fifth sequence when a row of sub-pixels of the display panel is scanned in an $N^{th}$ frame; and sequentially turning on the plurality of selection switches according to a sixth sequence when the row of sub-pixels of the display panel is scanned in an $(N+1)^{th}$ frame, wherein N is a positive integer greater than or equal to 1, and the fifth sequence is different from the sixth sequence.

In an embodiment, the plurality of selection switches comprise a first selection switch, a second selection switch, and a third selection switch, and wherein the fifth sequence and the sixth sequence satisfy one of the following conditions that:

the fifth sequence is (the first selection switch, the second selection switch, the third selection switch), and the sixth sequence is (the third selection switch, the second selection switch, the first selection switch); or the fifth sequence is (the first selection switch, the third selection switch, the second selection switch), and the sixth sequence is (the second selection switch, the third selection switch, the first selection switch); or the fifth sequence is (the second selection switch, the third selection switch, the first selection switch), and the sixth sequence is (the first selection switch, the third selection switch, the second selection switch); or the fifth sequence is (the second selection switch, the first selection switch, the third selection switch), and the sixth sequence is (the third selection switch, the first selection switch, the second selection switch); or the fifth sequence is (the third selection switch, the second selection switch, the first selection switch), and the sixth sequence is (the first selection switch, the second selection switch, the third selection switch); or the fifth sequence is (the third selection switch, the first selection switch, the second selection switch), and the sixth sequence is (the second selection switch, the first selection switch, the third selection switch).

In an embodiment, scanning a row of sub-pixels of the display panel in an $N^{th}$ frame comprises:

sequentially turning on the plurality of selection switches according to a seventh sequence when an $M^{th}$ row of sub-pixels of the display panel is scanned in the $N^{th}$ frame; and sequentially turning on the plurality of selection switches according to an eighth sequence when an $(M+1)^{th}$ row of sub-pixels of the display panel is scanned in the $N^{th}$ frame, wherein M is a positive integer greater than or equal to 1, and the seventh sequence is the same as or different from the eighth sequence.

According to the embodiments of the present disclosure, there is provided a computer readable storage medium having stored thereon executable instructions which, when executed by a processor, implement the method for driving a display panel described above.

BRIEF DESCRIPTION OF THE ACCOMPANYING DRAWINGS

The accompanying drawings are used to provide a further understanding of the technical solutions of the present disclosure, and constitute a part of the specification. The accompanying drawings are used together with the embodiments of the present application to explain the technical solutions of the present disclosure, and do not constitute a limitation of the technical solutions of the present disclosure.

DETAILED DESCRIPTION

In order to make the purposes, technical solutions and advantages of the present disclosure more obvious and apparent, the embodiments of the present disclosure will be described in detail below with reference to the accompanying drawings. It should be illustrated that, the embodiments in the present application and the features in the embodiments may be randomly combined with each other without conflict.

The steps illustrated in the flowcharts of the accompanying drawings may be executed in a computer system comprising, for example, a group of computer executable instructions. Further, although logical orders are shown in the flowcharts, in some cases, the steps shown or described may be performed in an order different from those described herein.

A method for driving a display panel and a computer readable storage medium are provided according to the embodiments of the present disclosure, wherein the display panel comprises a plurality of sub-pixels arranged in an array, a plurality of data input ports, a plurality of groups of data lines, and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels. In the method, the plurality of selection switches are sequentially turned on according to different sequences when an $M^{th}$ row of sub-pixels and an $(M+1)^{th}$ row of sub-pixels of the display panel are scanned. In the method according to the embodiment of the present disclosure, a turn-on timing of the selection switches can effectively avoid the differences in brightness of sub-pixels due to the same coupling state between respective rows of sub-pixels by a coupling compensation function, thereby solving the phenomenon of horizontal stripes appearing on the existing display panel. In addition, in the method according to the embodiment of the present disclosure, in a process of scanning adjacent rows of sub-pixels, in a case that a selection switch which is finally turned on when the $M^{th}$ row of sub-pixels is scanned is used as a selection switch which is firstly turned on when the $(M+1)^{th}$ row of sub-pixels is scanned, the power consumption for timing control of the display panel may be reduced to some extent.

The present disclosure provides the following specific embodiments which may be combined with each other, and the same or similar concepts or processes may not be described in detail in some embodiments.

Figure 1:
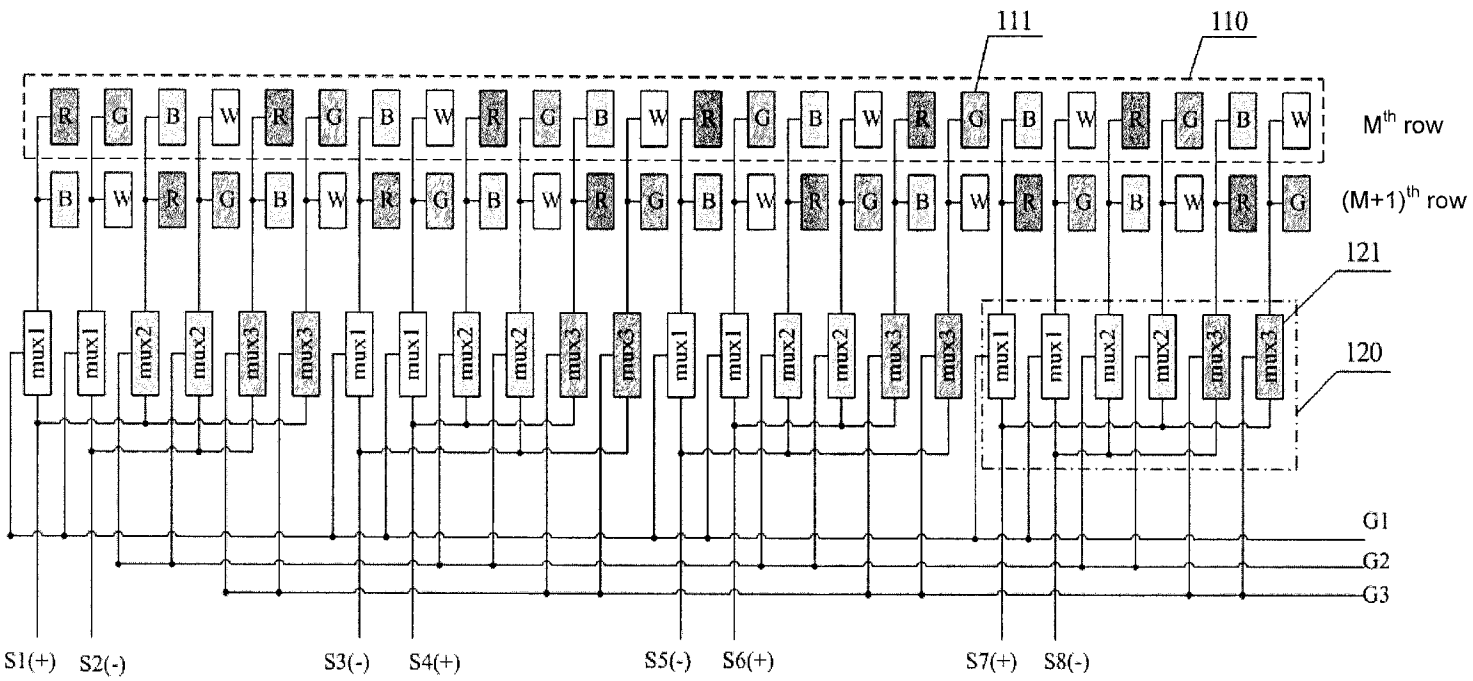
FIG. 1 is a schematic structural diagram of sub-pixels and selection switches in an existing display panel.

FIG. 1 is a schematic structural diagram of sub-pixels and selection switches in an existing display panel. The display panel illustrated in FIG. 1 comprises RGBW sub-pixels, and sub-pixels in adjacent rows of sub-pixels are arranged in different orders. In the arrangement of the sub-pixels, sub-pixels in an odd row and sub-pixels in an even row may be arranged in different orders. Alternatively, the sub-pixels in the rows of sub-pixels may be arranged in other orders. Selection switches (muxes) in FIG. 1 are arranged as a 1:3mux configuration, and a complete period of each row of sub-pixels and selection switches connected thereto is illustrated in FIG. 1. In one complete period, a plurality of sub-pixels with the same color (for example, six R sub-pixels) are coupled to two mux1, two mux2, and two mux3 in one-to-one correspondence, and the selection switches comprise a plurality of groups of switches. Each group of switches comprises two mux1, two mux2, and two mux3. In each group of switches, one mux1, one mux2, and one mux3 are coupled to one data input port, which inputs, for example, a positive voltage (S+), the other mux1, the other mux2, and the other mux3 are coupled to another data input port, which inputs, for example, a negative voltage (S−), wherein (S+) or (S−) is coupled to a source of a corresponding TFT, that is, a plurality of columns of sub-pixels are coupled to the same data input port through a group of switches (i.e., comprising mux1-mux3). For example, the same data voltage is input to sub-pixels (comprising R, B, and G sub-pixels) coupled to S1(+) through S1(+), and in FIG. 1, S1(+), S2(−), S3(−), S4(+), S5(−), S6(+), S7(+), and S8(−) are input ports for one data voltage respectively. For example, all mux1 are coupled to a scanning line 1 (G1), all mux2 are coupled to a scanning line 2 (G2), and all mux3 are coupled to a scanning line 3 (G3). The three scanning lines are used to control charging of sub-pixels coupled to different muxes (mux1, mux2 and mux3).

Figure 2:
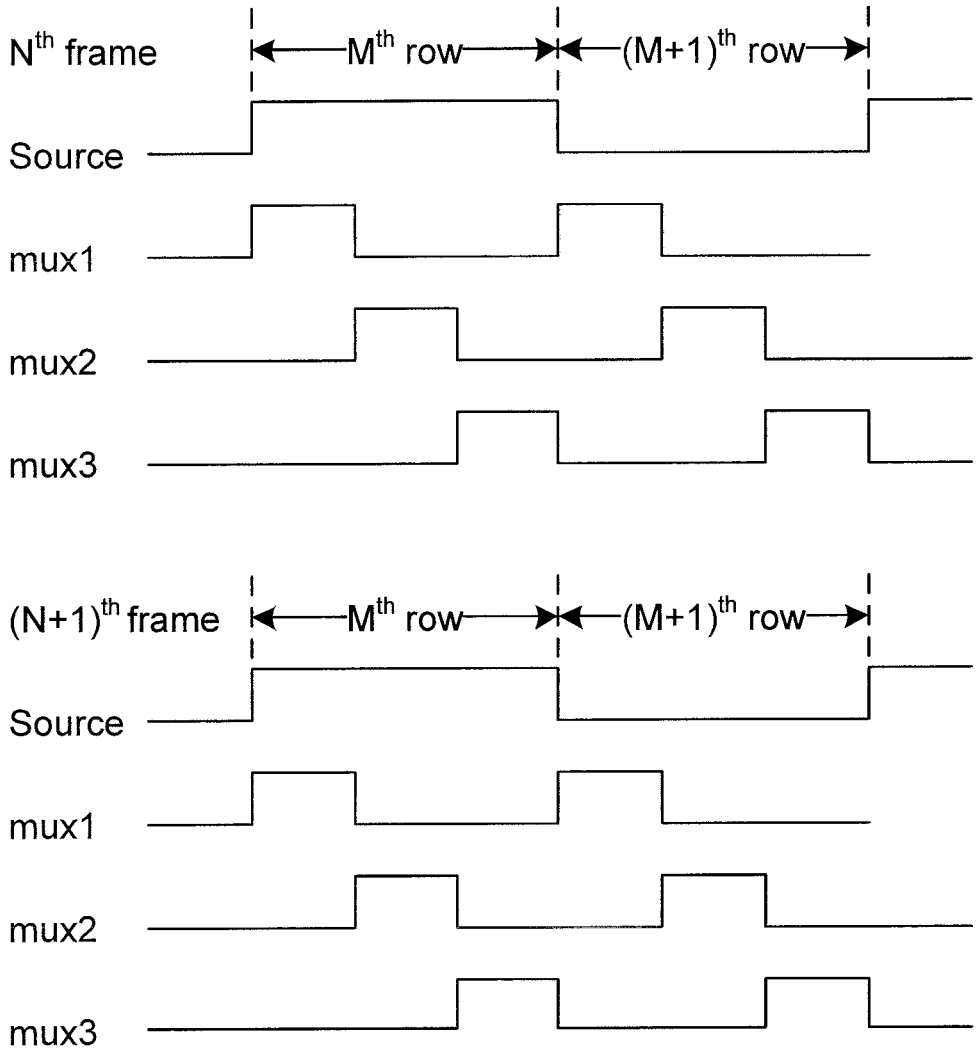
FIG. 2 is a schematic diagram of timing control of selection switches in the related art.

As shown in FIG. 2, illustrated is a schematic diagram of timing control of selection switches in the related art. In the timing shown in FIG. 2, in an Nth frame and an $(N+1)^{th}$ frame, mux1, mux2, and mux3 are turned on in an order of mux1→mux2→mux3, and for a scanning manner in the same frame (for example, the $N^{th}$ frame), muxes coupled to each row of sub-pixels are also turned on in an order of mux1→mux2→mux3. In combination with a manner in which the sub-pixels are coupled to the selection switches and an order in which the selection switches are turned on as shown in FIG. 1, sub-pixels in an odd row and sub-pixels in an even row shown in FIG. 1 have sub-pixels with different colors in the same column (the sub-pixels may also be arranged in other manners). Since a plurality of sub-pixels with the same color (for example, R sub-pixels) in the same row of sub-pixels are coupled to different muxes, there is the following problem: in a case of a specific display image (for example, a reloaded image, which is represented by an output waveform at a source in FIG. 2), there are differences in the charging of the plurality of sub-pixels with the same color. As shown in FIG. 1, some columns of sub-pixels are turned on by mux1 to be charged, some columns of sub-pixels are turned on by mux2 to be charged, and some columns of sub-pixels are turned on by mux3 to be charged. If adjacent columns of sub-pixels are charged by different muxes (a second column of sub-pixels and a third column of sub-pixels in FIG. 1 are charged by mux1 and mux2 respectively), then the mux (for example, mux2) which is later turned on may affect brightness of sub-pixels charged by the mux (for example, mux1) which is firstly turned on. Usually, sub-pixels charged by mux2 appear as darker sub-pixels, and sub-pixels charged by mux1 appear as brighter sub-pixels. Since sub-pixels with the same color (for example, R sub-pixels) in different columns and the same row are charged by different muxes (mux1-mux3), an order in which the muxes are turned on may affect brightness of the R sub-pixels in the respective columns, that is, some R sub-pixels appear as brighter sub-pixels and some R sub-pixels appear as darker sub-pixels, which results in differences in brightness of the plurality of sub-pixels with the same color, and thus there is a phenomenon of vertical stripes appearing on the display panel. In addition, in a case where the respective frames or/and the respective rows of sub-pixels have the same coupling state therebetween, since there are differences in brightness of sub-pixels due to coupling when each row of sub-pixels is turned on, there is a phenomenon of horizontal stripes appearing on the display panel.

Figure 3:
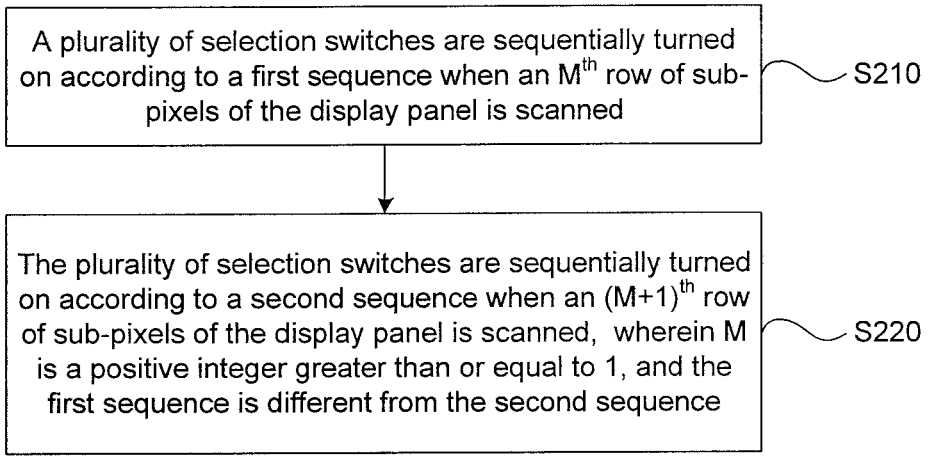
FIG. 3 is a flowchart of a method for driving a display panel according to an embodiment of the present disclosure.

FIG. 3 is a flowchart of a method for driving a display panel according to an embodiment of the present disclosure. The method for driving a display panel according to the embodiment may drive display of an existing display panel, and may comprise the following steps.

In S210, a plurality of selection switches are sequentially turned on according to a first sequence when an $M^{th}$ row of sub-pixels of the display panel is scanned.

In S220, the plurality of selection switches are sequentially turned on according to a second sequence when an $(M+1)^{th}$ row of sub-pixels of the display panel is scanned.

Here, M is a positive integer greater than or equal to 1, and the first sequence is different from the second sequence.

In the embodiment of the present disclosure, reference may be made to a structure of the display panel 100 shown in FIG. 1. The display panel 100 may comprise a plurality of sub-pixels 111 arranged in an array, a plurality of data input ports (the data input ports in FIG. 1 comprise S1-S8), a plurality of groups of data lines and a plurality of groups of selection switches 121, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels. FIG. 1 schematically illustrates two rows of sub-pixels 110, that is, an $M^{th}$ row of sub-pixels and an $(M+1)^{th}$ row of sub-pixels, and it is illustrated in FIG. 1 that each group of selection switches comprises three selection switches 121, that is, mux1, mux2, and mux3. A coupling relationship between sub-pixels 111 in each row of sub-pixels 110 and selection switches 121 is as shown in FIG. 1. It may be seen that sub-pixels with the same color are controlled to be turned on by different selection switches (for example, mux1, mux2, or mux3) to be charged. As shown in FIG. 1, the selection switches 121 which control the R sub-pixels to be turned on for charging the R sub-pixels comprise mux1 coupled to a data input port (S+) for inputting a positive voltage and mux1 coupled to a data input port (S−) for inputting a negative voltage, mux2 coupled to a data input port (S+) for inputting a positive voltage and mux2 coupled to a data input port (S−) for inputting a negative voltage, and mux3 coupled to a data input port (S+) for inputting a positive voltage and mux3 coupled to a data input port (S−) for inputting a negative voltage. In FIG. 1, S1(+), S2(−), S3(−), S4(+), S5(−), S6(+), S7(+), and S8(−) are coupled to different data lines. Further, for example, mux1-mux3 are coupled to G1-G3 in one-to-one correspondence, and mux1-mux3 are turned on through G1-G3 in a time division manner. During scanning, (S+) and (S−) are used for charging at the same time, and different voltages are applied by the respective data input ports of the display panel to sub-pixels coupled to the respective muxes through the respective muxes.

It should be illustrated that the embodiment of the present disclosure is described by taking each group of selection switches comprising three selection switches (mux1, mux2, mux3) as an example. In practical applications, each group of selection switches may comprise two, four, or five selection switches, or may also comprise more selection switches. A manner in which the sub-pixels 111 are coupled to the selection switches 121 and a manner in which the sub-pixels, the data input ports and the scanning lines are coupled in the display panel may be known with reference to the display panel 100 shown in FIG. 1.

In a process of driving the display panel, various rows of sub-pixels are usually scanned progressively, that is, the $(M+1)^{th}$ row of sub-pixels may be scanned after the $M^{th}$ row of sub-pixels is completely scanned. In the method for driving a display panel according to the embodiment of the present disclosure, the $M^{th}$ row of sub-pixels and the $(M+1)^{th}$ row of sub-pixels of the display panel are sequentially scanned. Since various sub-pixels in a plurality of rows of sub-pixels may be controlled to be turned on or turned off by a plurality of selection switches (muxes), that is, a certain row of sub-pixels may be selected or controlled to be turned on by the muxes, when a certain row of sub-pixels (for example, the $M^{th}$ row of sub-pixels) is scanned, selection switches coupled to the row of sub-pixels may be sequentially turned on according to a selection switch sequence. As an example, all the selection switches coupled to the $M^{th}$ row of sub-pixels may be sequentially turned on according to a preset sequence, for example, all the first selection switches (mux1) are firstly turned on, then all the second selection switches (mux2) are turned on, and finally all the third selection switches (mux3) are turned on. That is, for the $M^{th}$ row of sub-pixels, sub-pixels coupled to mux1 are firstly turned on to be charged, then sub-pixels coupled to mux2 are turned on to be charged, and finally sub-pixels coupled to mux3 are turned on to be charged. In this way, an operation of turning on all the sub-pixels in the $M^{th}$ row of sub-pixels is completed.

Figure 4:
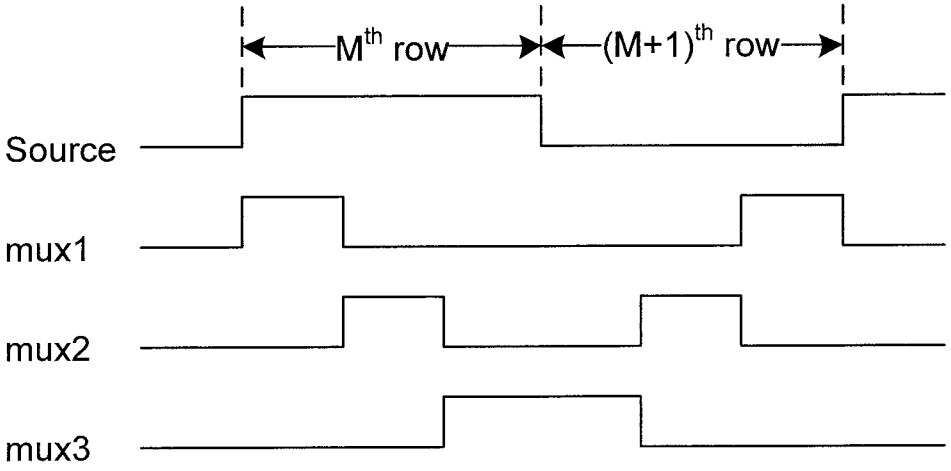
FIG. 4 is a schematic diagram of timing control of selection switches in a method for driving a display panel according to an embodiment of the present disclosure.

The turn-on timing of the muxes in the method according to the embodiment of the present disclosure differs from that in the related art is in that switches are turned on in different orders when adjacent rows of sub-pixels are scanned, for example, when the $M^{th}$ row of sub-pixels and the $(M+1)^{th}$ row of sub-pixels are scanned, as compared with a case in the related art that switches (muxes) are turned on in the same order when various rows of sub-pixels are scanned. As shown in FIG. 4, illustrated is a schematic diagram of timing control of selection switches in a method for driving a display panel according to an embodiment of the present disclosure. As may be seen from FIG. 4 and FIG. 2, in the existing timing shown in FIG. 2, the muxes are turned on in an order of mux1→mux2→mux3 when the $M^{th}$ row of sub-pixels and the $(M+1)^{th}$ row of sub-pixels are scanned, and in the timing according to the embodiment of the present disclosure shown in FIG. 4, the muxes are turned on in an order of mux1→mux2→mux3 when the $M^{th}$ row of sub-pixels is scanned, and the muxes are turned on in an order of mux3→mux2→mux1 when the $(M+1)^{th}$ row of sub-pixels is scanned. With the turn-on timing of the selection switches in the embodiment of the present disclosure, although there is also coupling when each row of sub-pixels is turned on, since the muxes are turned on in different orders when adjacent rows of sub-pixels are scanned, which results in a coupling compensation function, the differences in brightness of sub-pixels due to the same coupling state between respective rows of sub-pixels may be prevented, thereby avoiding the phenomenon of horizontal stripes appearing on the display panel. In addition, as may be seen from FIG. 4, mux3 is finally turned on when the $M^{th}$ row of sub-pixels is scanned, and mux3 is firstly turned on when the $(M+1)^{th}$ row of sub-pixels is scanned, that is, it is not necessary to turn off mux3 after the $M^{th}$ row of sub-pixels is completely scanned, and corresponding sub-pixels in the $(M+1)^{th}$ row of sub-pixels are directly selected to be turned on by mux3, which is a timing control manner beneficial to reduce the power consumption of the display panel.

It should be illustrated that, in the method for driving a display panel according to the embodiment of the present disclosure, when adjacent rows of sub-pixels (for example, the $M^{th}$ row of sub-pixels and the $(M+1)^{th}$ row of sub-pixels) are scanned, the order in which the muxes are turned on is not necessarily limited to the timing shown in FIG. 4, and the muxes may also be turned on in other orders, as long as the muxes are turned on in different orders when the adjacent rows of sub-pixels are scanned.

In the method for driving a display panel according to the embodiment of the present disclosure, the display panel comprises a plurality of sub-pixels arranged in an array, a plurality of data input ports, a plurality of groups of data lines, and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels. In the method, the selection switches are turned on in different orders when the $M^{th}$ row of sub-pixels and the $(M+1)^{th}$ row of sub-pixels of the display panel are scanned. In the method according to the embodiment of the present disclosure, a turn-on timing of the selection switches can effectively avoid the differences in brightness of sub-pixels due to the same coupling state between respective rows of sub-pixels by a coupling compensation function, thereby solving the phenomenon of horizontal stripes appearing on the existing display panel.

Further, in the method according to the embodiment of the present disclosure, in a process of scanning the adjacent rows of sub-pixels, a selection switch (for example, mux3 in FIG. 4) which is finally turned on when the $M^{th}$ row of sub-pixels is scanned may be used as a selection switch (for example, mux3 in FIG. 4) which is firstly turned on when the $(M+1)^{th}$ row of sub-pixels is scanned, which may reduce the power consumption for timing control of the display panel to some extent.

In the embodiment of the present disclosure, each group of selection switches may comprise two, three, four, five or six selection switches.

For example, the implementation of the timing control in the embodiment of the present disclosure is described by taking each group of selection switches comprising two selection switches as an example, that is, a first selection switch and a second selection switch. In the embodiment of the present disclosure, one of the following conditions may be realized when the $M^{th}$ row of sub-pixels and the $(M+1)^{th}$ row of sub-pixels are scanned.

In a first timing, the selection switches are turned on in an order of the first selection switch (mux1) and the second selection switch (mux2) when the $M^{th}$ row of sub-pixels is scanned; and the selection switches are turned on in an order of the second selection switch (mux2) and the first selection switch (mux1) when the $(M+1)^{th}$ row of sub-pixels is scanned.

In a second timing, the selection switches are turned on in an order of the second selection switch (mux2) and the first selection switch (mux1) when the $M^{th}$ row of sub-pixels is scanned; and the selection switches are turned on in an order of the first selection switch (mux1) and the second selection switch (mux2) when the $(M+1)^{th}$ row of sub-pixels is scanned.

Figure 5:
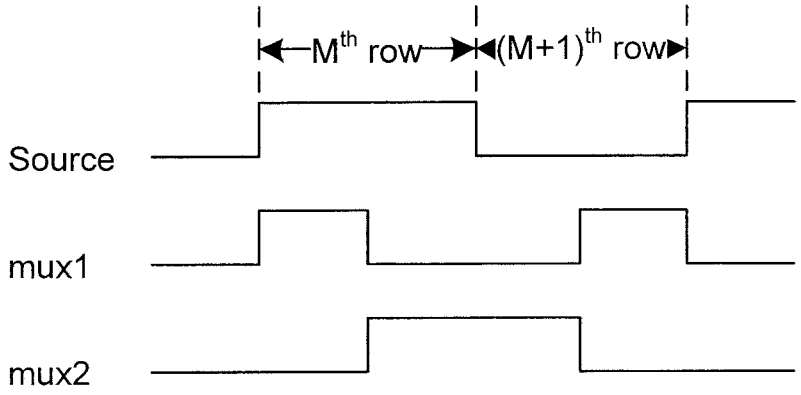
FIG. 5 is a schematic diagram of timing control of selection switches in a method for driving a display panel according to an embodiment of the present disclosure.

The first timing control is shown in FIG. 5, which illustrates a schematic diagram of timing control of selection switches in a method for driving a display panel according to an embodiment of the present disclosure. A timing diagram of the second timing may be known with reference to FIG. 5, except that only the order of mux1 and mux2 is changed.

For example, the implementation of the timing control in the embodiment of the present disclosure is described by taking each group of selection switches comprising three selection switches as an example, that is, a first selection switch, a second selection switch, and a third selection switch. In the embodiment of the present disclosure, one of the following conditions may be realized when the $M^{th}$ row of sub-pixels and the $(M+1)^{th}$ row of sub-pixels are scanned.

In a first timing, the selection switches are turned on in an order of the first selection switch, the second selection switch and the third selection switch when the $M^{th}$ row of sub-pixels is scanned; and the selection switches are turned on in an order of the third selection switch, the second selection switch and the first selection switch when the $(M+1)^{th}$ row of sub-pixels is scanned.

In a second timing, the selection switches are turned on in an order of the first selection switch, the third selection switch and the second selection switch when the $M^{th}$ row of sub-pixels is scanned; and the selection switches are turned on in an order of the second selection switch, the third selection switch and the first selection switch when the $(M+1)^{th}$ row of sub-pixels is scanned.

In a third timing, the selection switches are turned on in an order of the second selection switch, the third selection switch and the first selection switch when the $M^{th}$ row of sub-pixels is scanned; and the selection switches are turned on in an order of the first selection switch, the third selection switch and the second selection switch when the $(M+1)^{th}$ row of sub-pixels is scanned.

In a fourth timing, the selection switches are turned on in an order of the second selection switch, the first selection switch and the third selection switch when the $M^{th}$ row of sub-pixels is scanned; and the selection switches are turned on in an order of the third selection switch, the first selection switch and the second selection switch when the $(M+1)^{th}$ row of sub-pixels is scanned.

In a fifth timing, the selection switches are turned on in an order of the third selection switch, the second selection switch and the first selection switch when the $M^{th}$ row of sub-pixels is scanned; and the selection switches are turned on in an order of the first selection switch, the second selection switch and the third selection switch when the $(M+1)^{th}$ row of sub-pixels is scanned.

In a sixth timing, the selection switches are turned on in an order of the third selection switch, the first selection switch and the second selection switch when the $M^{th}$ row of sub-pixels is scanned; and the selection switches are turned on in an order of the second selection switch, the first selection switch and the third selection switch when the $(M+1)^{th}$ row of sub-pixels is scanned.

The above timing control schemes of the selection switches (muxes) are shown in Table 1 as follows.

TABLE 1

| Items | $M^{th}$ row of sub-pixels | $(M + 1)^{th}$ row of sub-pixels |
|---|---|---|
| First timing | mux1->mux2->mux3 | mux3->mux2->mux1 |
| Second timing | mux1->mux3->mux2 | mux2->mux3->mux1 |
| Third timing | mux2->mux3->mux1 | mux1->mux3->mux2 |
| Fourth timing | mux2->mux1->mux3 | mux3->mux1->mux2 |
| Fifth timing | mux3->mux2->mux1 | mux1->mux2->mux3 |
| Sixth timing | mux3->mux1->mux2 | mux2->mux1->mux3 |

The first timing control described above is shown in FIG. 4, and the timing diagrams of the second to sixth timings may be known with reference to FIG. 4, except that only the order of mux1, mux2, and mux3 is changed.

In the above embodiment, the turn-on timing of the selection switches when the adjacent rows of sub-pixels (i.e., the $M^{th}$ row of sub-pixels and the $(M+1)^{th}$ row of sub-pixels) of the display panel are scanned is mainly described. An implementation of scanning the same row of sub-pixels in different frames will be described below. In the following embodiments of the present disclosure, a timing control manner of the selection switches is described by taking three selection switches (i.e., mux1, mux2, mux3) as an example, and in some embodiments, a timing control manner of four selection switches is exemplified.

Figure 6:
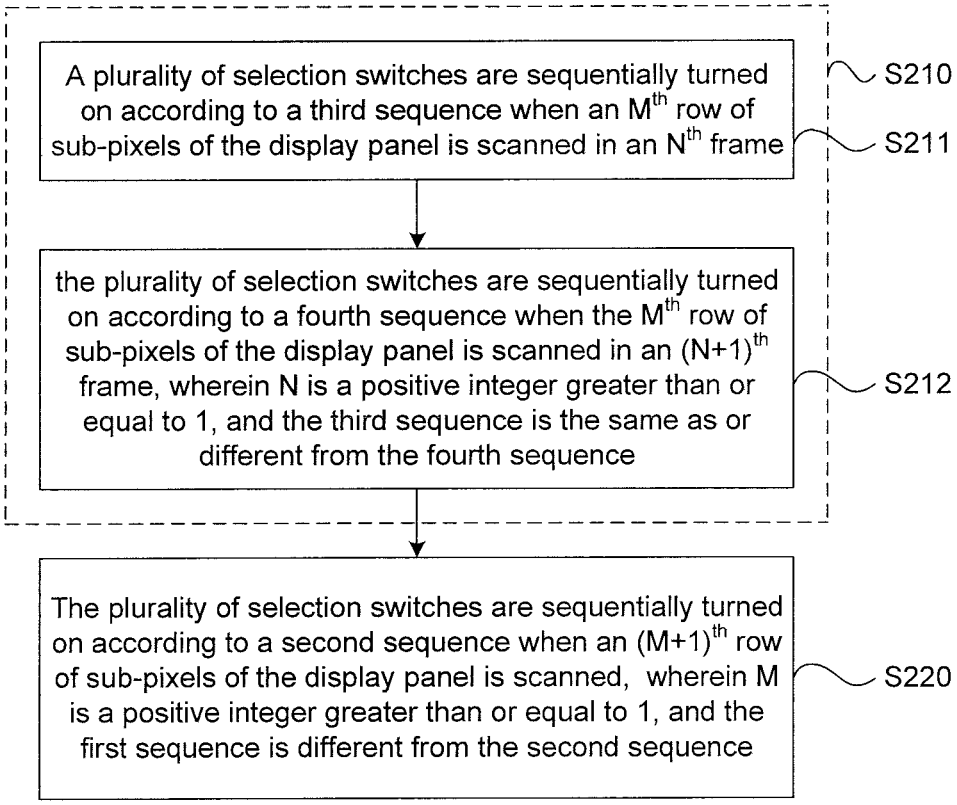
FIG. 6 is a flowchart of a method for driving a display panel according to an embodiment of the present disclosure.

FIG. 6 is a flowchart of a method for driving a display panel according to an embodiment of the present disclosure. On the basis of the embodiment shown in FIG. 3, in the method for driving a display panel according to the embodiment of the present disclosure, an implementation of S210 may comprise the following steps.

In S211, a plurality of selection switches are sequentially turned on according to a third sequence when an $M^{th}$ row of sub-pixels of the display panel is scanned in an $N^{th}$ frame.

In S212, the plurality of selection switches are sequentially turned on according to a fourth sequence when the $M^{th}$ row of sub-pixels of the display panel is scanned in an $(N+1)^{th}$ frame.

Here, N is a positive integer greater than or equal to 1, and the third sequence is the same as or different from the fourth sequence.

Figure 7:
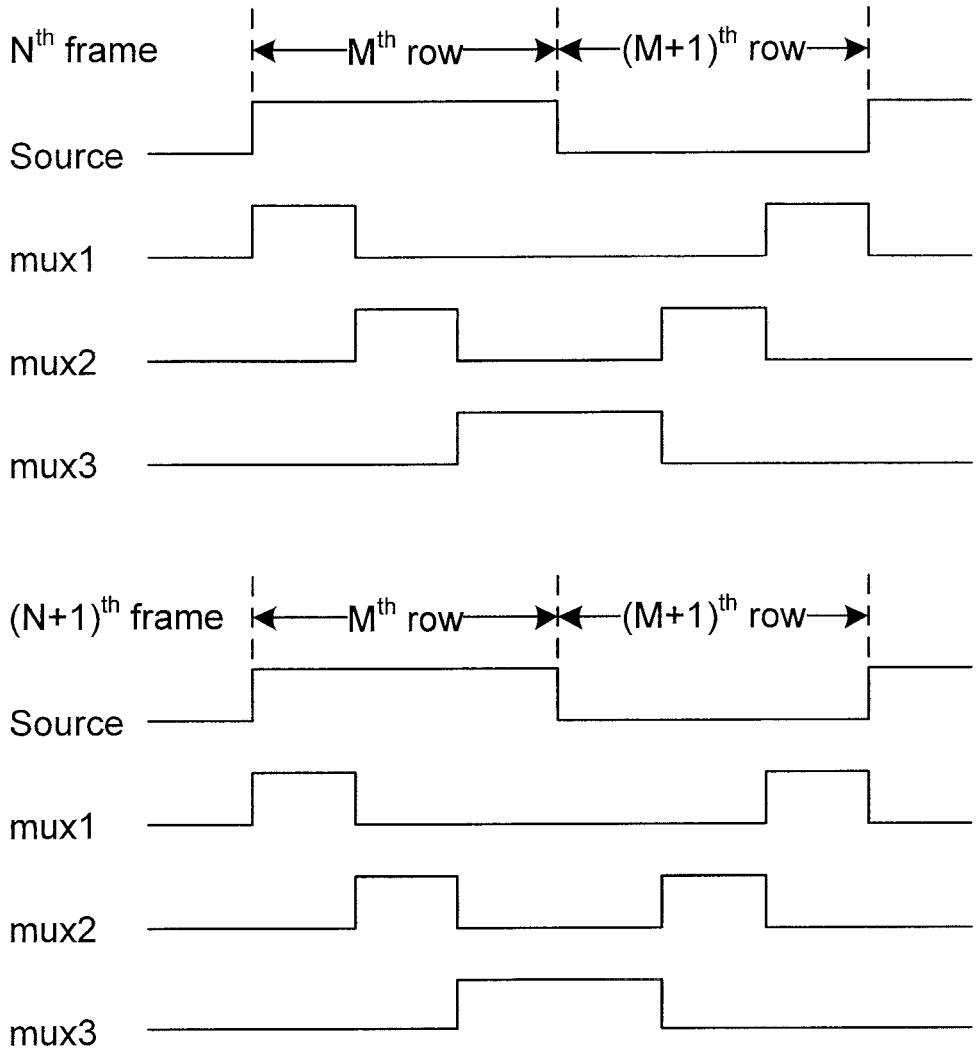
FIG. 7 is a schematic diagram of timing control of selection switches in a method for driving a display panel according to an embodiment of the present disclosure.

In an implementation of the embodiment of the present disclosure, the same timing of the selection switches is used when a certain row of sub-pixels (for example, the $M^{th}$ row of sub-pixels) is scanned in adjacent frames. As shown in FIG. 7, illustrated is a schematic diagram of timing control of selection switches in a method for driving a display panel according to an embodiment of the present disclosure. It may be seen that the three switches may be turned on in the same order, for example, in an order of mux1→mux2→mux3 (or in an order of mux3→mux2→mux1 in a case of the $(M+1)^{th}$ row of sub-pixels), when the $M^{th}$ row of sub-pixels (or the $(M+1)^{th}$ row of sub-pixels) is scanned in the $N^{th}$ frame and the $(N+1)^{th}$ frame.

In another implementation of the embodiment of the present disclosure, different timings of the selection switches are used when a certain row of sub-pixels (for example, the $M^{th}$ row of sub-pixels) is scanned in adjacent frames. In practical applications, the three selection switches may be turned on in different orders when the $M^{th}$ row of sub-pixels is scanned in the $N^{th}$ frame and the $(N+1)^{th}$ frame. In this implementation, one of the following conditions may be realized.

In a first timing, the selection switches are turned on in an order of the first selection switch, the second selection switch and the third selection switch when the $M^{th}$ row of sub-pixels is scanned in the $N^{th}$ frame; and the selection switches are turned on in an order of the third selection switch, the second selection switch, and the first selection switch when the $M^{th}$ row of sub-pixels is scanned in the $(N+1)^{th}$ frame.

In a second timing, the selection switches are turned on in an order of the first selection switch, the third selection switch and the second selection switch when the $M^{th}$ row of sub-pixels is scanned in the $N^{th}$ frame; and the selection switches are turned on in an order of the second selection switch, the third selection switch, and the first selection switch when the $M^{th}$ row of sub-pixels is scanned in the $(N+1)^{th}$ frame.

In a third timing, the selection switches are turned on in an order of the second selection switch, the third selection switch and the first selection switch when the $M^{th}$ row of sub-pixels is scanned in the $N^{th}$ frame; and the selection switches are turned on in an order of the first selection switch, the third selection switch, and the second selection switch when the $M^{th}$ row of sub-pixels is scanned in the $(N+1)^{th}$ frame.

In a fourth timing, the selection switches are turned on in an order of the second selection switch, the first selection switch and the third selection switch when the $M^{th}$ row of sub-pixels is scanned in the $N^{th}$ frame; and the selection switches are turned on in an order of the third selection switch, the first selection switch, and the second selection switch when the $M^{th}$ row of sub-pixels is scanned in the $(N+1)^{th}$ frame.

In a fifth timing, the selection switches are turned on in an order of the third selection switch, the second selection switch and the first selection switch when the $M^{th}$ row of sub-pixels is scanned in the $N^{th}$ frame; and the selection switches are turned on in an order of the first selection switch, the second selection switch, and the third selection switch when the $M^{th}$ row of sub-pixels is scanned in the $(N+1)^{th}$ frame.

In a sixth timing, the selection switches are turned on in an order of the third selection switch, the first selection switch and the second selection switch when the $M^{th}$ row of sub-pixels is scanned in the $N^{th}$ frame; and the selection switches are turned on in an order of the second selection switch, the first selection switch, and the third selection switch when the $M^{th}$ row of sub-pixels is scanned in the $(N+1)^{th}$ frame.

The above timing control schemes of the selection switches (muxes) is shown in Table 2 as follows.

TABLE 2

| Items | The $M^{th}$ row of sub-pixels is scanned in the $N^{th}$ frame | The $M^{th}$ row of sub-pixels is scanned in the $(N + 1)^{th}$ frame |
|---|---|---|
| First timing | mux1->mux2->mux3 | mux3->mux2->mux1 |
| Second timing | mux1->mux3->mux2 | mux2->mux3->mux1 |
| Third timing | mux2->mux3->mux1 | mux1->mux3->mux2 |
| Fourth timing | mux2->mux1->mux3 | mux3->mux1->mux2 |
| Fifth timing | mux3->mux2->mux1 | mux1->mux2->mux3 |
| Sixth timing | mux3->mux1->mux2 | mux2->mux1->mux3 |

The first timing control described above is shown in FIG. 8, which illustrates a schematic diagram of timing control of selection switches in a method for driving a display panel according to an embodiment of the present disclosure, and the timing diagrams of the second to sixth timings may be known with reference to FIG. 8, except that only the order of mux1, mux2, and mux3 is changed. With the timing control scheme in this implementation, the differences in brightness of sub-pixels due to the same coupling state between respective frames and between respective rows of sub-pixels may be effectively prevented by a coupling compensation function, thereby solving the phenomenon of vertical stripes and horizontal stripes appearing on the existing display panel.

It should be illustrated that, in the above various implementations, regardless of whether the timings of the selection switches are the same in the $N^{th}$ frame and the $(N+1)^{th}$ frame, the selection switches are turned on in different orders when adjacent rows of sub-pixels (for example, the $M^{th}$ row of sub-pixels and the $(M+1)^{th}$ row of sub-pixels in FIG. 1) are scanned. In addition, the implementation of S220 in the embodiment of the present disclosure is similar to that of S210 described above, that is, the $(M+1)^{th}$ row of sub-pixels may be scanned in the $N^{th}$ frame and the $(N+1)^{th}$ frame respectively, and the selection switches may be turned on in the same order or in different orders when the $(M+1)^{th}$ row of sub-pixels is scanned in the $N^{th}$ frame and the $(N+1)^{th}$ frame.

In the embodiment of the present disclosure, each row of sub-pixels 110 comprises RGBW sub-pixels 111, and adjacent rows of sub-pixels 110 (for example, the $M^{th}$ row of sub-pixels and the $(M+1)^{th}$ row of sub-pixels in FIG. 1) comprise sub-pixels with different colors in the same column. As shown in FIG. 1, the $M^{th}$ row and the $(M+1)^{th}$ row are adjacent rows, and the two rows of sub-pixels comprise sub-pixels with different colors in the same column.

In the embodiment of the present disclosure, the data input ports comprise a plurality of groups of data input ports each having a first data input port and a second data input port, and the selection switches 121 comprise a plurality of groups of selection switches 120. The first data input port is coupled to a group of data lines through one group of selection switches among two groups of selection switches, and the second data input port is coupled to another group of data lines through the other group of selection switches among the two groups of selection switches. As shown in FIG. 1, each two groups of selection switches 120 comprises two mux1, two mux2, and two mux3, wherein one mux1, one mux2, and one mux3 constitute one group of switches, and the other mux1, the other mux2, and the other mux3 constitute the other group of switches. Thereby, in columns of sub-pixels coupled to the two groups of switches 120, one half of the columns of sub-pixels is coupled to a first data input port of a group of data input ports through one group of the switches among the two groups of switches 120, and the other half of the columns of sub-pixels is coupled to a second data input port of the same group of data input ports through the other group of switches among the two groups of switches 120.

Here, the first data input port is configured to input a first data voltage.

The second data input port is configured to input a second data voltage having a polarity opposite to that of the first data voltage.

It is schematically illustrated in FIG. 1 that there are eight groups of switches 120 in one period of each row of sub-pixels 110. In each two groups of switches 120, sub-pixels are turned on to be charged by power-on of a positive voltage and a negative voltage, and timing control of the selection switches is implemented by turning on the selection switches in a time division manner. It should be illustrated that, in the embodiment of the present disclosure, in a group of ports (i.e., a first data input port and a second data input port) to which each two groups of switches 120 are coupled, one data input port inputs a positive voltage and the other data input port inputs a negative voltage, wherein the positive voltage and the negative voltage may be reversed. The embodiment shown in FIG. 1 is described by taking the first data input ports (S1, S4, S6, and S7 in FIG. 1) inputting a positive voltage and the second data input ports (S2, S3, S5, and S8 in FIG. 1) inputting a negative voltage as an example, and magnitudes of the first data voltage and the second data voltage are related to an image displayed on the display panel.

In the above pixel arrangement manner, if the timing control manner in the related art is used, it is easy to cause differences in charging of a plurality of sub-pixels with the same color in a case of a specific image, thereby causing differences in brightness of the sub-pixels with the same color, and there are differences in brightness of the sub-pixels due to the same coupling state between respective frames and between respective rows of sub-pixels, which may result in the phenomenon of horizontal stripes and vertical stripes appearing on the display panel. However, with the timing control scheme in the method according to the embodiment of the present disclosure, the above problem may be solved by the coupling compensation function.

Figure 9:
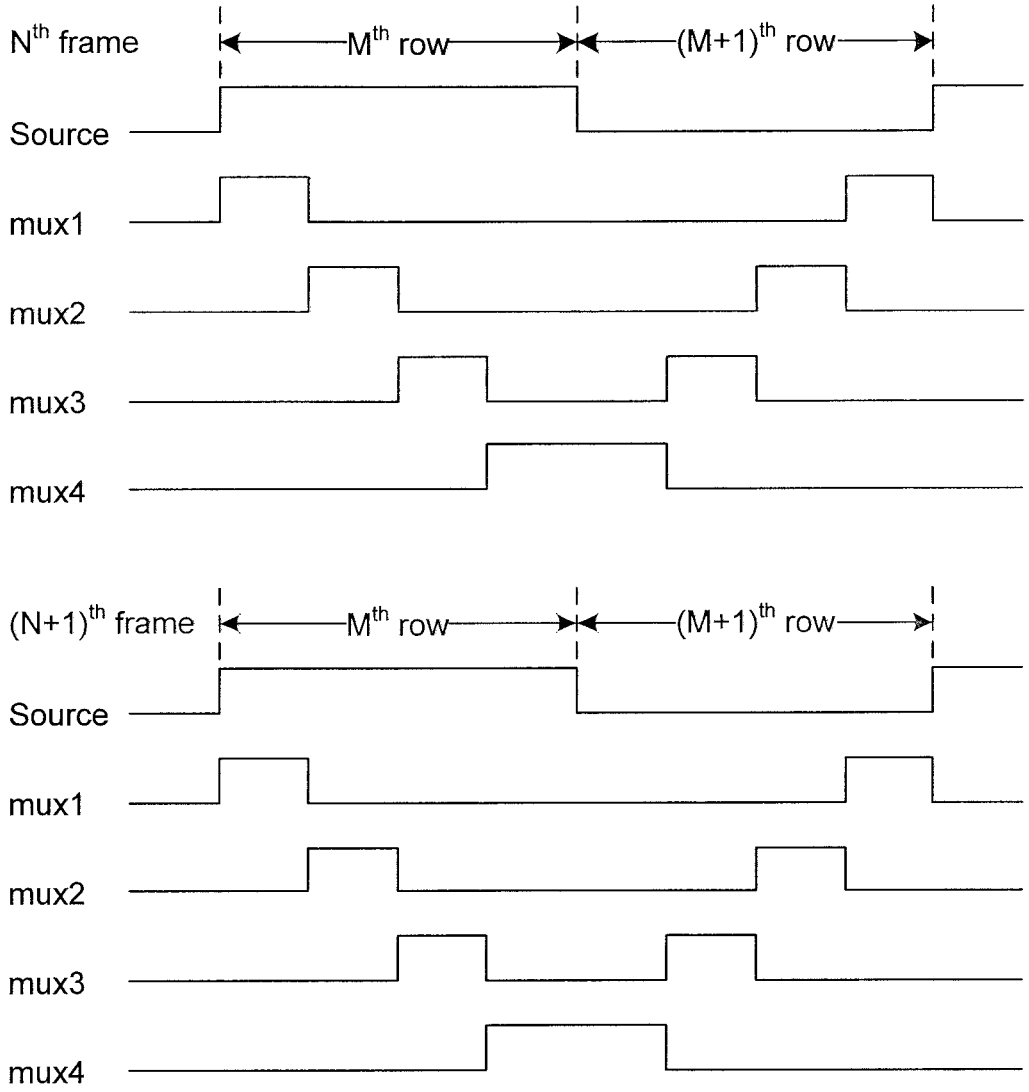
FIG. 9 is a schematic diagram of timing control of selection switches in a method for driving a display panel according to an embodiment of the present disclosure.

It should be illustrated that, in the above embodiment, one group of selection switches (i.e., mux1, mux2, mux3) is taken as an example to describe an implementation of timing control in the method according to the embodiment of the present disclosure, and in the embodiment of the present disclosure, one group of selection switches may also comprise two, four, five or six selection switches. By taking one group of selection switches comprising four selection switches (mux1, mux2, mux3, mux4) as an example, in a complete period of a row of sub-pixels, a plurality of sub-pixels with the same color are coupled to two mux1, two mux2, two mux3, and two mux4 in one-to-one correspondence, and in each group of switches 120, one mux1, one mux2, one mux3, and one mux4 are coupled to a first data input port for inputting a first data voltage, and the other mux1, the other mux2, the other mux3, and the other mux4 are coupled to a second data input port for inputting a second data voltage. With respect to the arrangement manner of the above four selection switches, the timing control manner may be as shown in FIG. 9, which is a schematic diagram of timing control of the selection switches in a method for driving a display panel according to an embodiment of the present disclosure. The timing shown in FIG. 9 is illustrated by taking the following conditions as an example: the selection switches are turned on in different orders when adjacent rows of sub-pixels (i.e., the $M^{th}$ row of sub-pixels and the $(M+1)^{th}$ row of sub-pixels) are scanned, and the two adjacent rows of sub-pixels are turned on in the same order in the $N^{th}$ frame and the $(N+1)^{th}$ frame.

Figure 10:
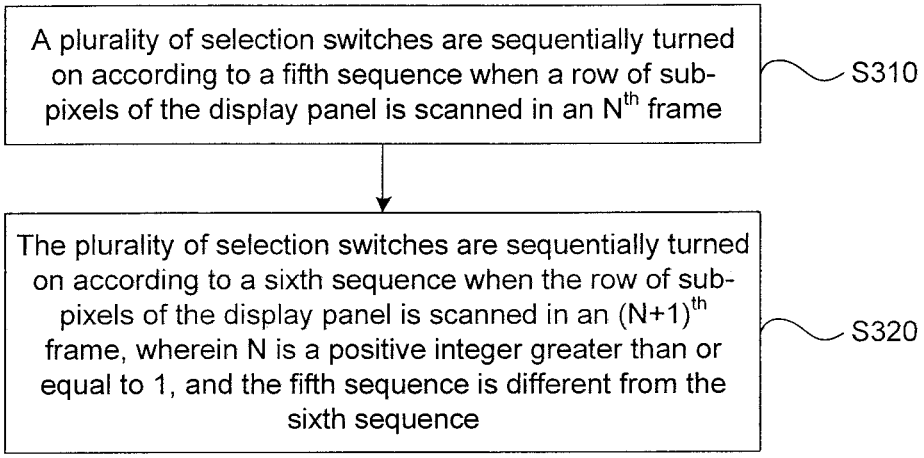
FIG. 10 is a flowchart of a method for driving a display panel according to an embodiment of the present disclosure.

FIG. 10 is a flowchart of a method for driving a display panel according to an embodiment of the present disclosure. The method for driving a display panel according to the present embodiment may drive display of the existing display panel, and may comprise the following steps.

In S310, a plurality of selection switches are sequentially turned on according to a fifth sequence when a row of sub-pixels of the display panel is scanned in an $N^{th}$ frame.

In S320, the plurality of selection switches are sequentially turned on according to a sixth sequence when the row of sub-pixels of the display panel is scanned in an $(N+1)^{th}$ frame.

Here, N is a positive integer greater than or equal to 1, and the fifth sequence is different from the sixth sequence.

The display panel 100 according to the embodiment of the present disclosure may also comprise a plurality of sub-pixels 111 arranged in an array, a plurality of data input ports (the data input ports in FIG. 1 comprise S1-S8), a plurality of groups of data lines, and a plurality of groups of selection switches, wherein each group of data lines among the plurality of groups of data lines comprises a plurality of data lines coupled to the same data input port through a plurality of selection switches 121 in a corresponding group of selection switches, and each of the plurality of data lines is coupled to a corresponding column of sub-pixels. In addition, the display panel according to the present embodiment may also be known with reference to the structure of the display panel 100 shown in FIG. 1. A manner in which the sub-pixels, the selection switches, the data input ports, the plurality of groups of data lines are coupled has been described in detail in the above embodiment, and will not be described in detail here.

It should be illustrated that the embodiment of the present disclosure is also illustrated by taking each group of selection switches comprising three selection switches (mux1, mux2, mux3) as an example. In practical applications, each group of selection switches may comprise two, four, or five selection switches, or may also comprise more selection switches. A manner in which the sub-pixels 111 are coupled to the selection switches 121 and a manner in which the sub-pixels, the data input ports and the scanning lines are coupled in the display panel may be known with reference to the display panel 100 shown in FIG. 1.

In the process of driving the display panel, various rows of sub-pixels are scanned progressively in a current frame (which is, for example, the $N^{th}$ frame), and various rows of sub-pixels continue to be scanned progressively in a next frame (which is the $(N+1)^{th}$ frame) after the scanning is completed in the current frame. In the method for driving a display panel according to the embodiment of the present disclosure, a row of sub-pixels of the display panel is sequentially scanned in the $N^{th}$ frame and the $(N+1)^{th}$ frame. Since various sub-pixels in each row of sub-pixels may be controlled to be turned on or turned off by a plurality of selection switches (muxes), that is, a certain row of sub-pixels is selected or controlled to be turned on by the muxes, in the process of scanning the same row of sub-pixels (for example, the $M^{th}$ row of sub-pixels) of the display panel, all the selection switches coupled to the row of sub-pixels may be turned on in a preset order, for example, all the first selection switches (mux1) are firstly turned on, then all the second selection switches (mux2) are turned on, and finally all the third selection switches (mux3) are turned on. That is, for the specific row of sub-pixels, sub-pixels coupled to mux1 are firstly turned on to be charged, then sub-pixels coupled to mux2 are turned on to be charged, and finally sub-pixels coupled to mux3 are turned on to be charged. In this way, an operation of turning on all the sub-pixels in the specific row of sub-pixels is completed.

Figure 8:
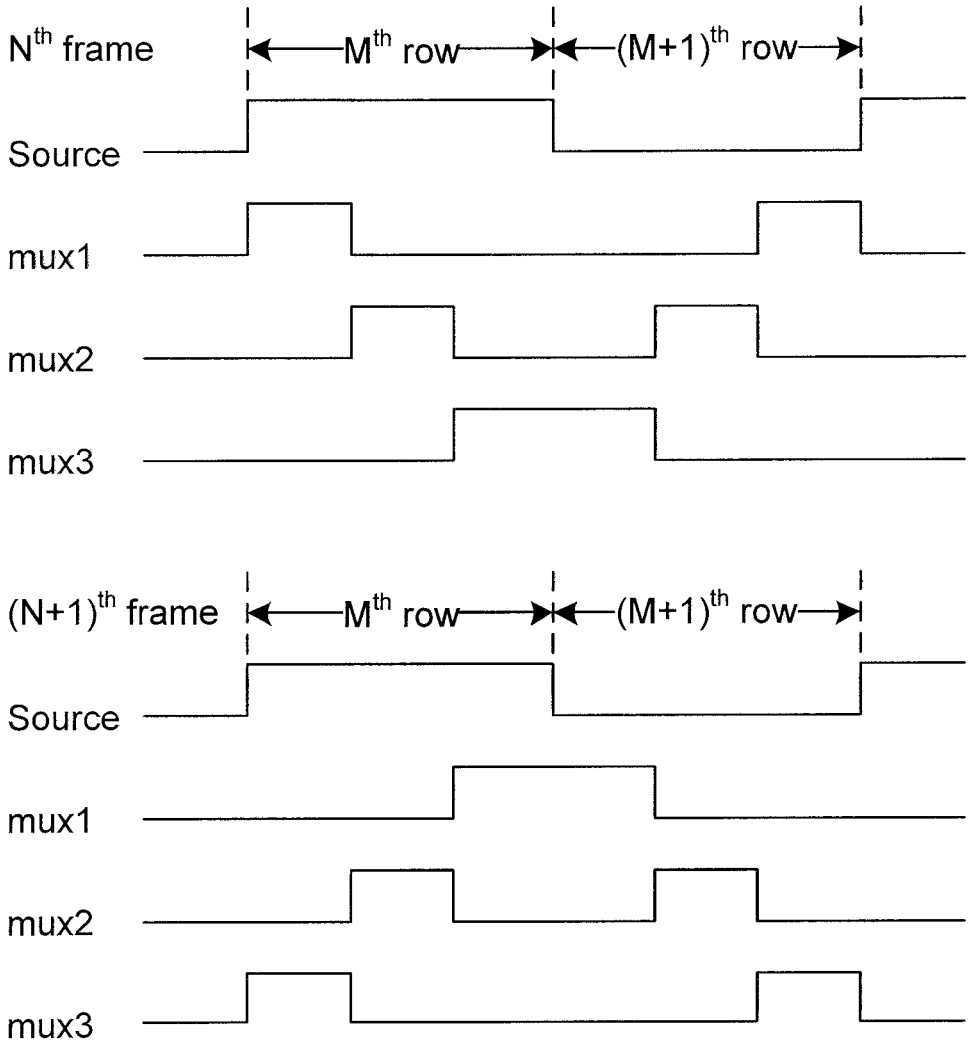
FIG. 8 is a schematic diagram of timing control of selection switches in a method for driving a display panel according to an embodiment of the present disclosure.

The turn-on timing of the muxes in the method according to the embodiment of the present disclosure differs from that in the related art is in that selection switches are turned on in different orders for the same row of sub-pixels when scanning is performed in adjacent frames, for example, when scanning is performed in the $N^{th}$ frame and the $(N+1)^{th}$ frame, as compared with a case in the related art that selection switches (muxes) are turned on in the same order when the same row of sub-pixels is scanned in various frames. As shown in FIG. 8, illustrated is a schematic diagram of timing control of selection switches. As may be seen from FIG. 8 and FIG. 2, in the existing timing shown in FIG. 2, the muxes are turned on in an order of mux1→mux2→mux3 when the same row of sub-pixels (the $M^{th}$ row of sub-pixels as shown in FIG. 2) of the display panel is scanned in the $N^{th}$ frame and the $(N+1)^{th}$ frame, and in the timing of the embodiment of the present disclosure shown in FIG. 8, the muxes are turned on in an order of mux1→mux2→mux3 when the specific row of sub-pixels (for example, the $M^{th}$ row of sub-pixels) is scanned in the $N^{th}$ frame, and the muxes are turned on in an order of mux3→mux2→mux1 when the specific row of sub-pixels (for example, the $M^{th}$ row of sub-pixels) is scanned in the $(N+1)^{th}$ frame. With the turn-on timing of the selection switches according to the embodiment of the present disclosure, although there is also coupling when the same row of sub-pixels is scanned in adjacent frames, since the muxes are turned on in different orders in the process of performing scanning in the adjacent frames which results in a coupling compensation function, the differences in brightness of sub-pixels due to the same coupling state between respective frames and between respective sub-pixels can be prevented, thereby avoiding the phenomenon of vertical stripes appearing on the display panel. In addition, it may be seen from FIG. 8 that mux3 is finally turned on when the $M^{th}$ row of sub-pixels is scanned in the $N^{th}$ frame and the $(N+1)^{th}$ frame, and mux3 is firstly turned on when the $(M+1)^{th}$ row of sub-pixels is scanned in the $N^{th}$ frame and the $(N+1)^{th}$ frame, that is, it is not necessary to turn off mux3 after the $M^{th}$ row of sub-pixels is completely scanned, and corresponding sub-pixels in the $(M+1)^{th}$ row of sub-pixels are directly selected to be turned on by mux3, which is a timing control manner beneficial to reduce the power consumption of the display panel.

It should be illustrated that, in the method for driving a display panel according to the embodiment of the present disclosure, when the same row of sub-pixels is scanned in adjacent frames (for example, the $N^{th}$ frame and the $(N+1)^{th}$ frame), the order in which the muxes are turned on is not necessarily limited to the timing shown in FIG. 8, and the muxes may also be turned on in other orders, as long as the muxes are turned on in different orders when the same row of sub-pixels is scanned in the adjacent frames.

In the method for driving a display panel according to the embodiment of the present disclosure, the display panel comprises a plurality of sub-pixels arranged in an array, a plurality of data input ports, a plurality of groups of data lines, and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels. In the method, rows of sub-pixels of the display panel are scanned in the $N^{th}$ frame and the $(N+1)^{th}$ frame. The selection switches are turned on in different orders when the same row of sub-pixels of the display panel is scanned in the $N^{th}$ frame and the $(N+1)^{th}$ frame. In the method according to the embodiment of the present disclosure, a turn-on timing of the selection switches can effectively avoid the differences in brightness of sub-pixels due to the same coupling state between respective frames and between respective rows of sub-pixels by a coupling compensation function, thereby solving the phenomenon of vertical stripes appearing on the existing display panel.

Further, in the method according to the embodiment of the present disclosure, in a process of performing scanning in the same frame (for example, the $N^{th}$ frame or the $(N+1)^{th}$ frame as shown in FIG. 8), a selection switch (mux3 in FIG. 8) which is finally turned on when the $M^{th}$ row of sub-pixels is scanned may be used as a selection switch (mux3 in FIG. 8) which is firstly turned on when the $(M+1)^{th}$ row of sub-pixels is scanned, which may reduce the power consumption for timing control of the display panel to some extent.

In the embodiment of the present disclosure, each group of selection switches may comprise two, three, four, five or six selection switches.

For example, the implementation of the timing control in the embodiment of the present disclosure is described by taking each group of selection switches comprising two selection switches as an example, that is, a first selection switch and a second selection switch. In the embodiment of the present disclosure, one of the following conditions may be realized when a row of sub-pixels of the display panel is scanned in the $N^{th}$ frame and the $(N+1)^{th}$ frame.

In a first timing, the selection switches are turned on in an order of the first selection switch and the second selection switch when the same row of sub-pixels is scanned in the $N^{th}$ frame; and the selection switches are turned on in an order of the second selection switch and the first selection switch when the same row of sub-pixels is scanned in the $(N+1)^{th}$ frame.

In a second timing, the selection switches are turned on in an order of the second selection switch and the first selection switch when the same row of sub-pixels is scanned in the $N^{th}$ frame; and the selection switches are turned on in an order of the first selection switch and the second selection switch when the same row of sub-pixels is scanned in the $(N+1)^{th}$ frame.

For example, the implementation of the timing control in the embodiment of the present disclosure is described by taking each group of selection switches comprising three selection switches as an example, that is, a first selection switch, a second selection switch, and a third selection switch. In the embodiment of the present disclosure, one of the following conditions may be realized when a row of sub-pixels of the display panel is scanned in the $N^{th}$ frame and the $(N+1)^{th}$ frame.

In a first timing, the selection switches are turned on in an order of the first selection switch, the second selection switch and the third selection switch when the same row of sub-pixels is scanned in the $N^{th}$ frame; and the selection switches are turned on in an order of the third selection switch, the second selection switch and the first selection switch when the same row of sub-pixels is scanned in the $(N+1)^{th}$ frame.

In a second timing, the selection switches are turned on in an order of the first selection switch, the third selection switch and the second selection switch when the same row of sub-pixels is scanned in the $N^{th}$ frame; and the selection switches are turned on in an order of the second selection switch, the third selection switch and the first selection switch when the same row of sub-pixels is scanned in the $(N+1)^{th}$ frame.

In a third timing, the selection switches are turned on in an order of the second selection switch, the third selection switch and the first selection switch when the same row of sub-pixels is scanned in the $N^{th}$ frame; and the selection switches are turned on in an order of the first selection switch, the third selection switch and the second selection switch when the same row of sub-pixels is scanned in the $(N+1)^{th}$ frame.

In a fourth timing, the selection switches are turned on in an order of the second selection switch, the first selection switch and the third selection switch when the same row of sub-pixels is scanned in the $N^{th}$ frame; and the selection switches are turned on in an order of the third selection switch, the first selection switch and the second selection switch when the same row of sub-pixels is scanned in the $(N+1)^{th}$ frame.

In a fifth timing, the selection switches are turned on in an order of the third selection switch, the second selection switch and the first selection switch when the same row of sub-pixels is scanned in the $N^{th}$ frame; and the selection switches are turned on in an order of the first selection switch, the second selection switch and the third selection switch when the same row of sub-pixels is scanned in the $(N+1)^{th}$ frame.

In a sixth timing, the selection switches are turned on in an order of the third selection switch, the first selection switch and the second selection switch when the same row of sub-pixels is scanned in the $N^{th}$ frame; and the selection switches are turned on in an order of the second selection switch, the first selection switch and the third selection switch when the same row of sub-pixels is scanned in the $(N+1)^{th}$ frame.

In the above timing control schemes of the selection switches (muxes), the same row of sub-pixels may refer to the $M^{th}$ row of sub-pixels in FIG. 8, or the $(M+1)^{th}$ row of sub-pixels in FIG. 8, or another row of sub-pixels not shown n FIG. 8. The above timing control schemes of the muxes are shown in Table 3 as follows.

TABLE 3

| Items | The $M^{th}$ row of sub-pixels is scanned in the $N^{th}$ frame | The $M^{th}$ row of sub-pixels is scanned in the $(N + 1)^{th}$ frame |
|---|---|---|
| First timing | mux1->mux2->mux3 | mux3->mux2->mux1 |
| Second timing | mux1->mux3->mux2 | mux2->mux3->mux1 |
| Third timing | mux2->mux3->mux1 | mux1->mux3->mux2 |
| Fourth timing | mux2->mux1->mux3 | mux3->mux1->mux2 |
| Fifth timing | mux3->mux2->mux1 | mux1->mux2->mux3 |
| Sixth timing | mux3->mux1->mux2 | mux2->mux1->mux3 |

The above table 3 is described by taking performing scanning in the the $N^{th}$ frame and the $(N+1)^{th}$ frame as an example. The first timing control described above is shown in FIG. 8, and the timing diagrams of the second to sixth timings may be known with reference to FIG. 8, except that only the order of mux1, mux2, and mux3 is changed.

In the above embodiment, the turn-on timing of the selection switches when the same row of sub-pixels (i.e., the $M^{th}$ row of sub-pixels or the $(M+1)^{th}$ row of sub-pixels) of the display panel is scanned in adjacent frames (i.e., the $N^{th}$ frame and the $(N+1)^{th}$ frame) is mainly described. An implementation of scanning adjacent rows of sub-pixels (i.e., the $M^{th}$ row of sub-pixels and the $(M+1)^{th}$ row of sub-pixels) in the same frame (for example, the $N^{th}$ frame) will be described below.

Figure 11:
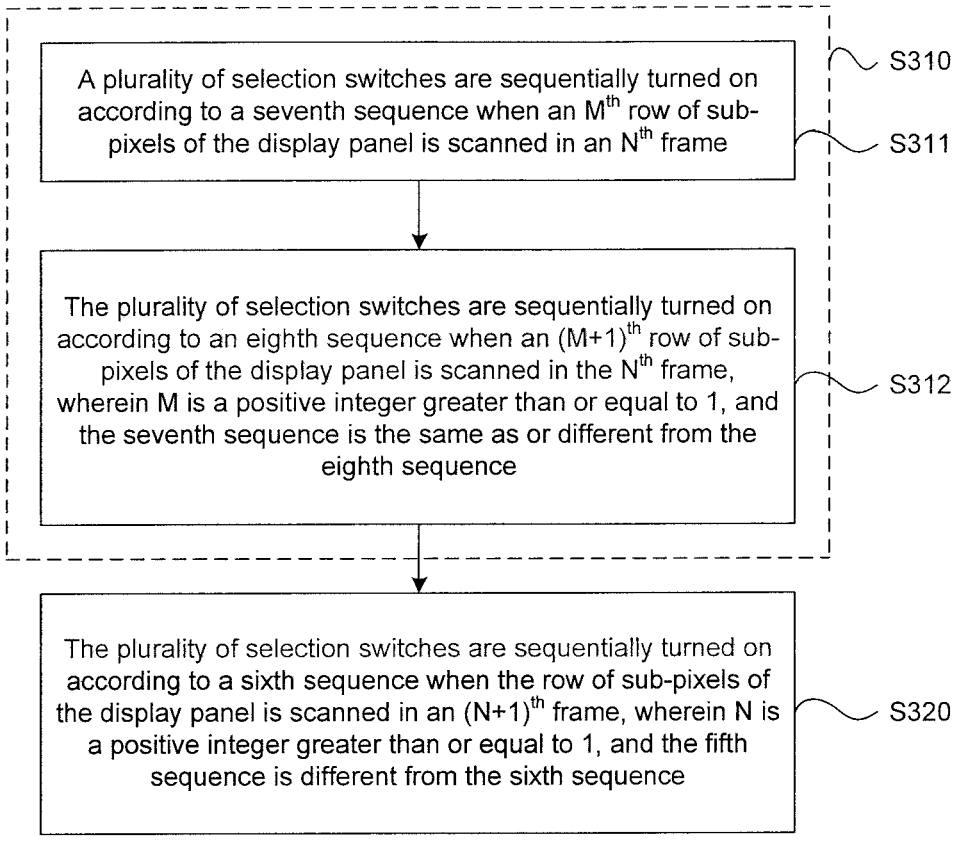
FIG. 11 is a flowchart of a method for driving a display panel according to an embodiment of the present disclosure.

FIG. 11 is a flowchart of a method for driving a display panel according to an embodiment of the present disclosure. On the basis of the embodiment shown in FIG. 10, in the method for driving a display panel according to the embodiment of the present disclosure, an implementation of S310 may comprise the following steps.

In S311, a plurality of selection switches are sequentially turned on according to a seventh sequence when an $M^{th}$ row of sub-pixels of the display panel is scanned in an $N^{th}$ frame.

In S312, the plurality of selection switches are sequentially turned on according to an eighth sequence when an $(M+1)^{th}$ row of sub-pixels of the display panel is scanned in the $N^{th}$ frame.

Here, M is a positive integer greater than or equal to 1, and the seventh sequence is the same as or different from the eighth sequence.

Figure 12:
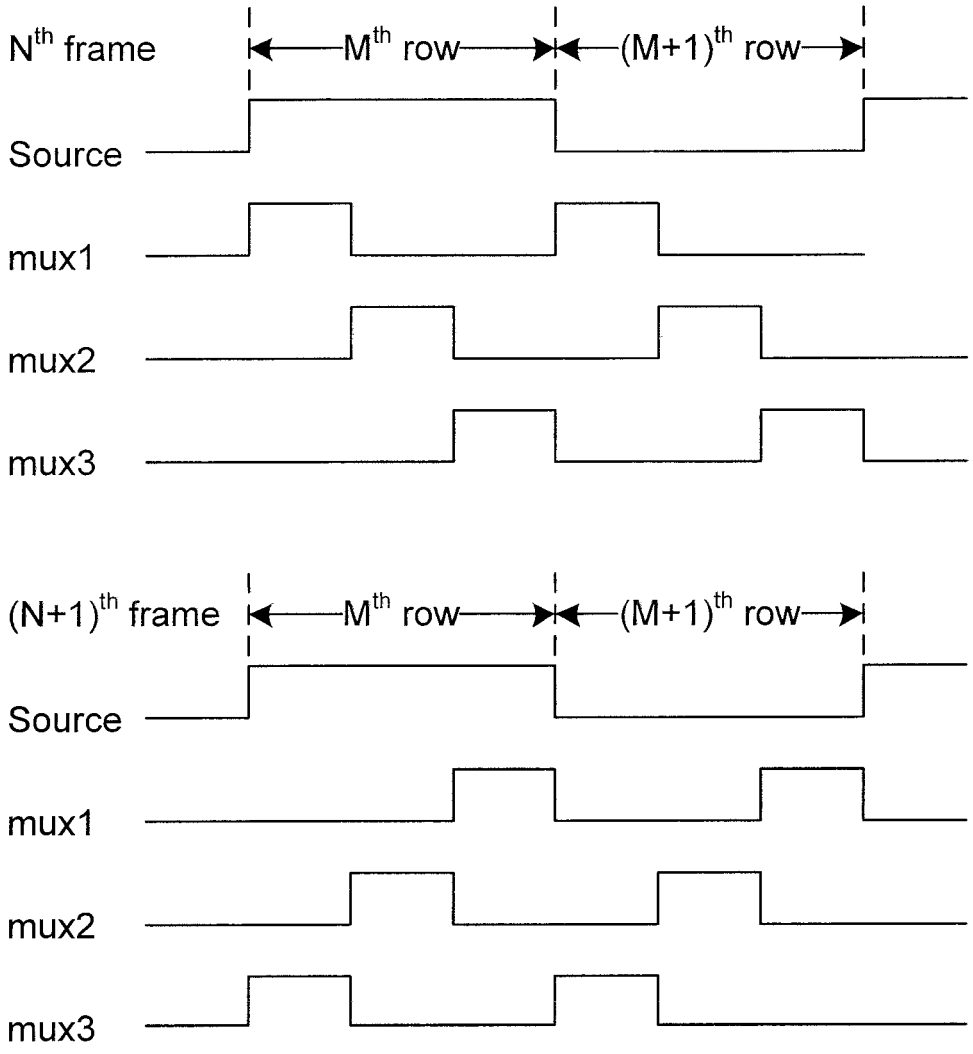
FIG. 12 is a schematic diagram of timing control of selection switches in a method for driving a display panel according to an embodiment of the present disclosure.

In an implementation of the embodiment of the present disclosure, the same timing of the selection switches is used when adjacent rows of sub-pixels (for example, the $M^{th}$ row of sub-pixels and the $(M+1)^{th}$ row of sub-pixels) are scanned in the same frame (for example, the $N^{th}$ frame). As shown in FIG. 12, illustrated is a schematic diagram of timing control of selection switches in a method for driving a display panel according to an embodiment of the present disclosure. It may be seen that the three selection switches may be turned on in the same order, for example, in an order of mux1→mux2→mux3 when the $M^{th}$ row of sub-pixels and the $(M+1)^{th}$ row of sub-pixels are scanned in the $N^{th}$ frame. It should be illustrated that in the timing control scheme, three selection switches are turned on in different orders when the same rows of sub-pixels (for example, the $M^{th}$ row of sub-pixels and the $(M+1)^{th}$ row of sub-pixels) are scanned in adjacent frames (for example, the $N^{th}$ frame and the $(N+1)^{th}$ frame). As shown in FIG. 12, when the $M^{th}$ row of sub-pixels and the $(M+1)^{th}$ row of sub-pixels are scanned in the $(N+1)^{th}$ frame, the three selection switches are turned on in an order of mux3→mux2→mux1.

In another implementation of the embodiment of the present disclosure, in the process of scanning adjacent rows of sub-pixels (for example, the $M^{th}$ row of sub-pixels and the $(M+1)^{th}$ row of sub-pixels) in the same frame (for example, the $N^{th}$ frame), the selection switches are turned on according to different timings. A timing control scheme of the selection switches in this implementation may be known with reference to the six timings shown in Table 2 above and the timing control diagram shown in FIG. 8, and will not be described in detail here. With the timing control scheme in the implementation, the differences in brightness of sub-pixels due to the same coupling state between respective frames and between respective rows of sub-pixels may be effectively prevented by a coupling compensation function, thereby solving the phenomenon of horizontal stripes and vertical stripes appearing on the existing display panel. In addition, the implementation of S320 in the embodiment of the present disclosure is similar to that of S310 described above, that is, the $M^{th}$ row of sub-pixels and the $(M+1)^{th}$ row of sub-pixels may also be scanned in the $(N+1)^{th}$ frame respectively, and the selection switches are turned on in different orders or in the same order when the $M^{th}$ row of sub-pixels and the $(M+1)^{th}$ row of sub-pixels are scanned in the $(N+1)^{th}$ frame.

It should be illustrated that, in the display panel according to the embodiment of the present disclosure, a color configuration of sub-pixels in each row of sub-pixels and a manner in which sub-pixels in each row of sub-pixels are arranged, as well as a manner in which columns of sub-pixels, the selection switches, the data input ports, the data lines, and the scanning lines are coupled have been described in detail in the above embodiments, and therefore will not be described in detail here.

Figure 13:
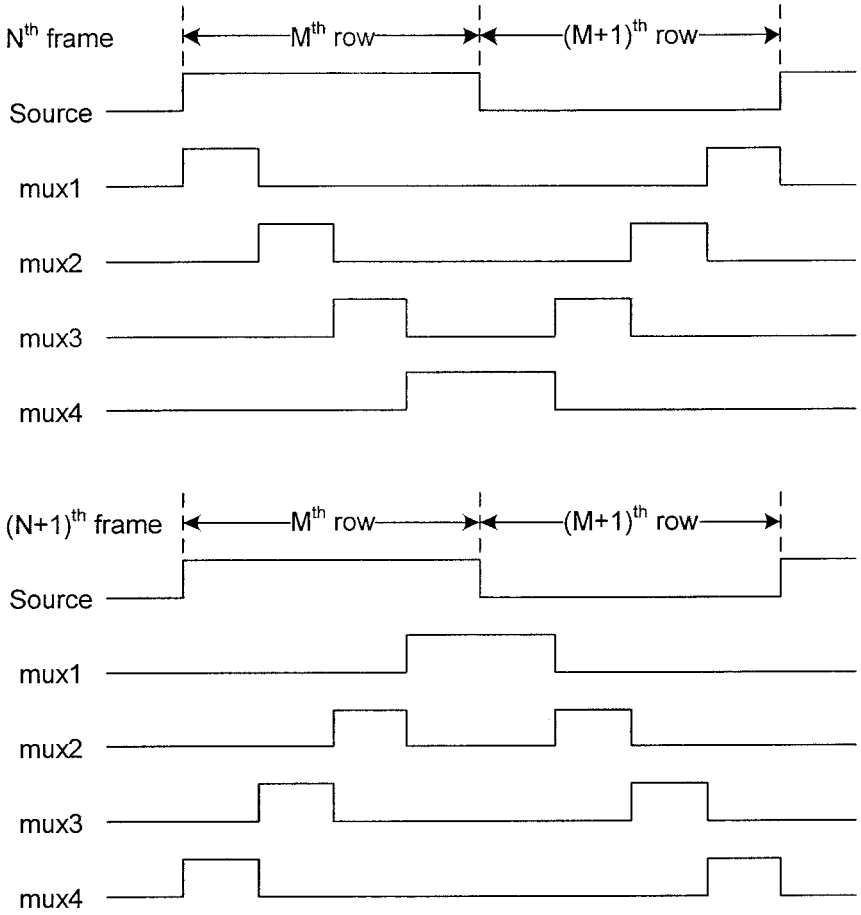
FIG. 13 is a schematic diagram of timing control of selection switches in a method for driving a display panel according to an embodiment of the present disclosure.

In practical applications, each group of selection switches in the embodiment of the present disclosure comprises two, four, five or six selection switches, and the present embodiment is described by taking each group of selection switches comprising four selection switches (mux1, mux2, mux3, mux4) as an example. A manner in which the four selection switches are coupled to the sub-pixels has been described in detail in the above embodiments, and therefore will not be described in detail here. With respect to the arrangement manner of the above four selection switches, the timing control manner may be as shown in FIG. 13, which is a schematic diagram of timing control of the selection switches in a method for driving a display panel according to the embodiment of the present disclosure. The timing shown in FIG. 13 is illustrated by taking the following conditions as an example: the four selection switches are turned on in different orders when the same row of sub-pixels (i.e., the $M^{th}$ row of sub-pixels or the $(M+1)^{th}$ row of sub-pixels) is scanned in adjacent pixels (i.e., the $N^{th}$ frame and the $(N+1)^{th}$ frame), and the four selection switches are also turned on in different orders when the two adjacent rows of sub-pixels are scanned in the same frame (i.e., the $N^{th}$ frame or the $(N+1)^{th}$ frame).

Based on the method for driving a display panel according to the above embodiments of the present disclosure, the embodiments of the present disclosure further provide a display apparatus, which has a hardware structure for performing the method for driving a display panel according to any of the above embodiments of the present disclosure.

Figure 14:
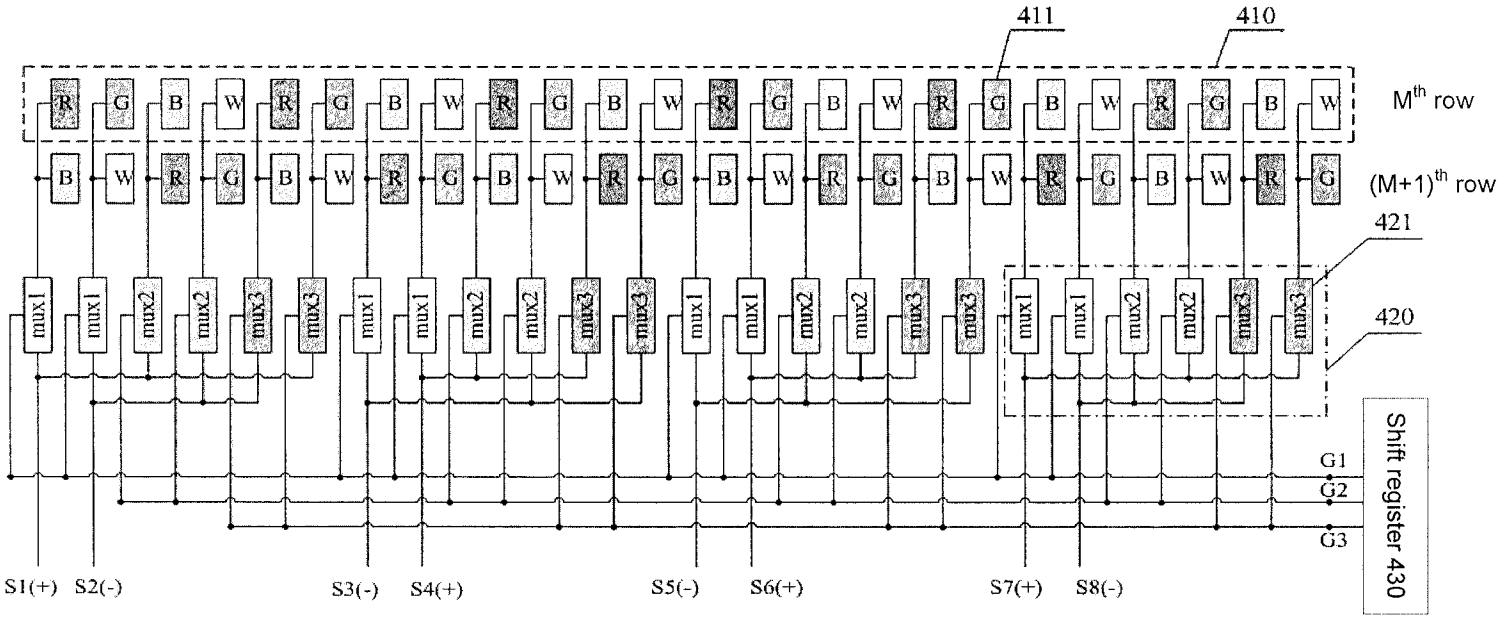
FIG. 14 is a schematic structural diagram of a display apparatus according to an embodiment of the present disclosure.

As shown in FIG. 14, illustrated is a schematic structural diagram of a display apparatus according to an embodiment of the present disclosure. The display apparatus according to the present embodiment may comprise: a plurality of sub-pixels 411 arranged in an array, a plurality of data input ports (the data input ports in FIG. 14 comprise S1-S8), a plurality of groups of data lines, and a plurality of groups of selection switches, wherein each group of data lines among the plurality of groups of data lines comprises a plurality of data lines coupled to the same data input port through a plurality of selection switches 421 in a corresponding group of selection switches (FIG. 14 is illustrated by taking the group of selection switches comprising three selection switches mux1-mux3 as an example) and each of the plurality of data lines is coupled to a corresponding column of sub-pixels. FIG. 14 schematically illustrates two rows of sub-pixels 410, i.e., an $M^{th}$ row of sub-pixels and an $(M+1)^{th}$ row of sub-pixels, and schematically illustrates three selection switches 421, i.e., mux1, mux2, and mux3. A coupling relationship between sub-pixels 411 in each row of sub-pixels and selection switches 421 is as shown in FIG. 14. It may be seen that sub-pixels with the same color are controlled to be turned on by different selection switches (for example, mux1, mux2, or mux3) to be charged. As shown in FIG. 14, selection switches 421 which controls R sub-pixels to be turned on for charging the R sub-pixels comprises mux1 coupled to a data input port (S+) for inputting a positive voltage and mux1 coupled to a data input port (S−) for inputting a negative voltage, mux2 coupled to a data input port (S+) for inputting a positive voltage and mux2 coupled to a data input port (S−) for inputting a negative voltage, and mux3 coupled to a data input port (S+) for inputting a positive voltage and mux3 coupled to a data input port (S−) for inputting a negative voltage. In FIG. 14, S1(+), S2(−), S3(−), S4(+), S5(−), S6(+), S7(+), and S8(−) are coupled to different data lines. In addition, as shown in FIG. 14, mux1 is coupled to G1, mux2 is coupled to G2, and mux3 is coupled to G3. The display apparatus further comprises a shift register 430 coupled to each of the scanning lines G (three scanning lines G1-G3 illustrated in FIG. 14). In addition, in the embodiment of the present disclosure, a manner in which the sub-pixels 411 are coupled to the selection switches 421 and a manner in which the selection switches 421, the data input ports and the scanning lines are coupled as well as a division manner and a coupling manner of the groups of switches 420 may be known with reference to the display panel shown in FIG. 1 and the above embodiments.

In the embodiment of the present disclosure, the shift register 430 is configured to sequentially turn on a plurality of selection switches according to a first sequence when an $M^{th}$ row of sub-pixels of the display panel is scanned.

The shift register 430 is further configured to sequentially turn on the plurality of selection switches according to a second sequence when an $(M+1)^{th}$ row of sub-pixels of the display panel is scanned.

Here, M is a positive integer greater than or equal to 1, and the first sequence is different from the second sequence.

In the embodiment of the present disclosure, based on the structure of the display panel 100 shown in FIG. 1, the shift register 430 for timing control of selection switches through scanning lines is further configured. It should be illustrated that, in the display apparatus according to the embodiment of the present disclosure, a manner in which various rows of sub-pixels are coupled to the selection switches and a manner in which the selection switches, the data input ports and the scanning lines are coupled may be known with reference to the display panel 100 shown in FIG. 1.

In the embodiment of the present disclosure, the shift register 430 may scan the $M^{th}$ row of sub-pixels 410 of the display panel 400 in the following implementation.

The shift register 430 is further configured to sequentially turn on the plurality of selection switches according to a third sequence when the $M^{th}$ row of sub-pixels of the display panel is scanned in an $N^{th}$ frame.

The shift register 430 is further configured to sequentially turn on the plurality of selection switches according to a fourth sequence when the $M^{th}$ row of sub-pixels of the display panel is scanned in an $(N+1)^{th}$ frame.

Here, N is a positive integer greater than or equal to 1, and the third sequence is the same as or different from the fourth sequence.

In the embodiment of the present disclosure, various implementations, beneficial effects, and timing control diagrams of timing control of the selection switches 421 by the shift register 430 may be known with reference to the embodiments shown in FIG. 3 to FIG. 9, and will not be described in detail here.

The embodiments of the present disclosure further provide a display apparatus. The display apparatus according to the present embodiment may be known with reference to FIG. 14. A specific structure of the display apparatus has been described in detail in the above embodiments, and therefore will not be described in detail here.

In the embodiment of the present disclosure, the shift register 430 is configured to turn on a plurality of selection switches according to a fifth sequence when a row of sub-pixels of the display panel is scanned in an $N^{th}$ frame.

The shift register 430 is further configured to turn on the plurality of selection switches according to a sixth sequence when the row of sub-pixels of the display panel is scanned in an $(N+1)^{th}$ frame.

Here, N is a positive integer greater than or equal to 1, and the fifth sequence is different from the sixth sequence.

In the embodiment of the present disclosure, based on the structure of the display panel 100 shown in FIG. 1, the shift register 430 for timing control of selection switches through scanning lines is further configured. It should be illustrated that, in the display apparatus according to the embodiment of the present disclosure, a manner in which various rows of sub-pixels are coupled to the selection switches and a manner in which the selection switches, the data input ports and the scanning lines are coupled may be known with reference to the display panel 100 shown in FIG. 1.

In the embodiment of the present disclosure, the shift register 430 may scan the row of sub-pixels 410 of the display panel 400 in the $N^{th}$ frame in the following implementation.

The shift register 430 is further configured to sequentially turn on the plurality of selection switches according to a seventh sequence when an $M^{th}$ row of sub-pixels of the display panel 400 is scanned in the $N^{th}$ frame.

The shift register 430 is further configured to sequentially turn on the plurality of selection switches according to an eighth sequence when an $(M+1)^{th}$ row of sub-pixels of the display panel 400 is scanned in the $N^{th}$ frame.

Here, M is a positive integer greater than or equal to 1, and the seventh sequence is the same as or different from the eighth sequence.

In the embodiment of the present disclosure, various implementations, beneficial effects, and timing control diagrams of timing control of the selection switches 421 by the shift register 430 may be known with reference to the embodiments shown in FIG. 10 to FIG. 13, and will not be described in detail here.

The embodiments of the present disclosure further provide a computer readable storage medium having stored thereon executable instructions which, when executed by a processor, may implement the method for driving a display panel according to any of the above embodiments of the present disclosure. The computer readable storage medium according to the embodiment of the present disclosure may be implemented in the same manner as that of the method for driving a display panel according to the above embodiments of the present disclosure, and will not be described in detail here.

Although the embodiments disclosed in the present disclosure are as described above, the content described is merely implementations used to facilitate the understanding of the present disclosure, and is not intended to limit the present disclosure. Any modification and variation in forms and details of the implementations may be made by those skilled in the art without departing from the spirit and scope of the present disclosure, but the patent protection scope of the present disclosure should still be defined by the scope of the appended claims.

We claim:

1. A method for driving a display panel, the display panel comprising a plurality of sub-pixels arranged in an array, a plurality of data input ports, a plurality of groups of data lines, and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels, the plurality of selection switches comprise a first selection switch, a second selection switch, and a third selection switch, the method comprising:

turning on the plurality of selection switches in an order of the first selection switch, the second selections switch, and the third selection switch when an $M^{th}$ row of sub-pixels of the display panel is scanned; and turning on the plurality of selection switches in an order of the first selection switch, the second selection switch, and the third selection switch when an $(M+1)^{th}$ row of sub-pixels of the display panel is scanned, or turning on the plurality selection switches in an order of the first selection switch, the third selection switch, the second selection switch when an $M^{th}$ row of sub-pixels of the display panel is scanned; and turning on the plurality of selection switches the selection switches in an order of the second selection switch, the third selection switch, the first selection switch when an $(M+1)^{th}$ row of sub-pixels of the display panel is scanned, wherein M is a positive integer greater than or equal to 1, and wherein the sub-pixels comprise red, green, blue, and white sub-pixels, and adjacent rows of sub-pixels have sub-pixels with different colors in the same column, and the sub-pixels with the same color are controlled to be turned on by different selection switches to be charged.

2. The method according to claim 1, further comprises:

turning on the plurality selection switches in an order of the second selection switch, the third selection switch, the first selection switch when an $M^{th}$ row of sub-pixels of the display panel is scanned; and turning on the plurality of selection switches the selection switches in an order of the first selection switch, the third selection switch, the second selection switch when an $(M+1)^{th}$ row of sub pixels of the display panel is scanned, or turning on the plurality selection switches in an order of the second selection switch, the first selection switch, the third selection switch when an $M^{th}$ row of sub-pixels of the display panel is scanned; and turning on the plurality of selection switches the selection switches in an order of the third selection switch, the first selection switch, the second selection switch when an $(M+1)^{th}$ row of sub-pixels of the display panel is scanned.

3. The method according to claim 1, further comprises:

turning on the plurality selection switches in an order of the second selection switch, the third selection switch, the first selection switch when an $M^{th}$ row of sub-pixels of the display panel is scanned; and turning on the plurality of selection switches the selection switches in an order of the first selection switch, the third selection switch, the second selection switch when an $(M+1)^{th}$ row of sub pixels of the display panel is scanned, or turning on the plurality selection switches in an order of the second selection switch, the first selection switch, the third selection switch when an $M^{th}$ row of sub-pixels of the display panel is scanned; and turning on the plurality of selection switches the selection switches in an order of the third selection switch, the first selection switch, the second selection switch when an $(M+1)^{th}$ row of sub-pixels of the display panel is scanned.

4. The method according to claim 1, wherein scanning an $M^{th}$ row of sub-pixels of the display panel comprises:

turning on the plurality of selection switches in an order of the first selection switch, the second selection switch, the third selection switch when the $M^{th}$ row of sub-pixels of the display panel is scanned in an $N^{th}$ frame; and turning on the plurality of selection switches in an order of the third selection switch, the second selection switch, the first selection switch when the $M^{th}$ row of sub-pixels of the display panel is scanned in an $(N+1)^{th}$ frame, wherein N is a positive integer greater than or equal to 1.

5. The method according to claim 4, wherein scanning an $M^{th}$ row of sub-pixels of the display panel further comprises:

turning on the plurality of selection switches in an order of the first selection switch, the third selection switch, the second selection switch when the $M^{th}$ row of sub-pixels of the display panel is scanned in an $N^{th}$ frame; and turning on the plurality of selection switches in an order of the second selection switch, the third selection switch, the first selection switch when the $M^{th}$ row of sub-pixels of the display panel is scanned in an $(N+1)^{th}$ frame.

6. The method according to claim 4, wherein scanning an $M^{th}$ row of sub-pixels of the display panel further comprises:

turning on the plurality of selection switches in an order of the second selection switch, the third selection switch, the first selection switch when the $M^{th}$ row of sub-pixels of the display panel is scanned in an $N^{th}$ frame; and turning on the plurality of selection switches in an order of the first selection switch, the third selection switch, the second selection switch when the $M^{th}$ row of sub-pixels of the display panel is scanned in an $(N+1)^{th}$ frame.

7. The method according to claim 4, wherein scanning an $M^{th}$ row of sub-pixels of the display panel further comprises:

turning on the plurality of selection switches in an order of the second selection switch, the first selection switch, the third selection switch when the $M^{th}$ row of sub-pixels of the display panel is scanned in an $N^{th}$ frame; and turning on the plurality of selection switches in an order of the third selection switch, the first selection switch, the second selection switch when the $M^{th}$ row of sub-pixels of the display panel is scanned in an $(N+1)^{th}$ frame.

8. The method according to claim 4, wherein scanning an $M^{th}$ row of sub-pixels of the display panel further comprises:

turning on the plurality of selection switches in an order of the third selection switch, the second selection switch, the first selection switch when the $M^{th}$ row of sub-pixels of the display panel is scanned in an $N^{th}$ frame; and turning on the plurality of selection switches in an order of the first selection switch, the second selection switch, the third selection switch when the $M^{th}$ row of sub-pixels of the display panel is scanned in an $(N+1)^{th}$ frame.

9. The method according to claim 4, wherein scanning an $M^{th}$ row of sub-pixels of the display panel further comprises:

turning on the plurality of selection switches in an order of the third selection switch, the first selection switch, the second selection switch when the $M^{th}$ row of sub-pixels of the display panel is scanned in an $N^{th}$ frame; and turning on the plurality of selection switches in an order of the second selection switch, the first selection switch, the third selection switch when the $M^{th}$ row of sub-pixels of the display panel is scanned in an $(N+1)^{th}$ frame.

10. The method according to claim 1, wherein the plurality of data input ports comprise a plurality of groups of data input ports, each group of data input ports among the plurality of groups of data input ports has a first data input port and a second data port, the first data input port is coupled to a group of data lines through one group of selection switches among two groups of selection switches, and the second data input port is coupled to another group of data lines through the other group of selection switches among the two groups of selection switches, wherein the first data input port is configured to input a first data voltage, and the second data input port is configured to input a second data voltage having a polarity opposite to that of the first data voltage.

11. A tangible computer readable storage medium having stored thereon executable instructions which, when executed by a processor, implement the method according to claim 1.

12. A method for driving a display panel, the display panel comprising a plurality of sub-pixels arranged in an array, a plurality of data input ports, a plurality of groups of data lines and a plurality of groups of selection switches, wherein each group of data lines among the plurality of groups of data lines comprises a plurality of data lines coupled to the same data input port through a plurality of selection switches in a corresponding group of selection switches, and each of the plurality of data lines is coupled to a corresponding column of sub-pixels, the plurality of selection switches comprise a first selection switch, a second selection switch, and a third selection switch, the method comprising:

turning on the plurality of selection switches in an order of the first selection switch, the second selection switch, the third selection switch when a row of sub-pixels of the display panel is scanned in an $N^{th}$ frame; and turning on the plurality of selection switches in an order of the third selection switch, the second selection switch, the first selection switch when the row of sub-pixels of the display panel is scanned in an $(N+1)^{th}$ frame, or turning on the plurality of selection switches in an order of the first selection switch, the third selection switch, the second selection switch when a row of sub-pixels of the display panel is scanned in an $N^{th}$ frame; and turning on the plurality of selection switches in an order of the second selection switch, the third selection switch, the first selection switch when the row of sub-pixels of the display panel is scanned in an $(N+1)^{th}$ frame, or turning on the plurality of selection switches in an order of the second selection switch, the third selection switch, the first selection switch when a row of sub-pixels of the display panel is scanned in an $N^{th}$ frame; and turning on the plurality of selection switches in an order of the first selection switch, the third selection switch, the second selection switch when the row of sub-pixels of the display panel is scanned in an $(N+1)^{th}$ frame, or turning on the plurality of selection switches in an order of the second selection switch, the first selection switch, the third selection switch when a row of sub-pixels of the display panel is scanned in an $N^{th}$ frame; and turning on the plurality of selection switches in an order of the third selection switch, the first selection switch, the second selection switch when the row of sub-pixels of the display panel is scanned in an $(N+1)^{th}$ frame, or turning on the plurality of selection switches in an order of the third selection switch, the second selection switch, the first selection switch when a row of sub-pixels of the display panel is scanned in an $N^{th}$ frame; and turning on the plurality of selection switches in an order of the second selection switch, the first selection switch, the third selection switch when the row of sub-pixels of the display panel is scanned in an $(N+1)^{th}$ frame, or turning on the plurality of selection switches in an order of the third selection switch, the first selection switch, the second selection switch when the row of sub-pixels of the display panel is scanned in an $N^{th}$ frame; and turning on the plurality of selection switches in an order of the second selection switch, the first selection switch, the third selection switch when the row of sub-pixels of the display panel is scanned in an $(N+1)^{th}$ frame;

wherein N is a positive integer greater than or equal to 1, and wherein the sub-pixels comprise red, green, blue, and white sub-pixels, and adjacent rows of sub-pixels have sub-pixels with different colors in the same column, and the sub-pixels with the same color are controlled to be turned on by different selection switches to be charged.

13. The method according to claim 12, wherein scanning a row of sub-pixels of the display panel in an $N^{th}$ frame comprises:

turning on the plurality selection switches in an order of the first selection switch, the second selection switch, and the third selection switch when an $M^{th}$ row of sub-pixels of the display panel is scanned; and turning on the plurality of selection switches the selection switches in an order of the third selection switch, the second selection switch, the first selection switch when an $(M+1)^{th}$ row of sub-pixels of the display panel is scanned, or turning on the plurality selection switches in an order of the first selection switch, the third selection switch, the second selection switch when an $M^{th}$ row of sub-pixels of the display panel is scanned; and turning on the plurality of selection switches the selection switches in an order of the second selection switch, the third selection switch, the first selection switch when an $(M+1)^{th}$ row of sub-pixels of the display panel is scanned; and wherein M is a positive integer greater than or equal to 1.

14. A tangible computer readable storage medium having stored thereon executable instructions which, when executed by a processor, implement the method according to claim 12.

* * * * *